US005755206A

United States Patent [19]

Takahashi et al.

[11] Patent Number: 5,755,206

[45] Date of Patent: May 26, 1998

[54] CONTROL METHOD AND APPARATUS FOR INTERNAL COMBUSTION ENGINE

[75] Inventors: Yasuhiro Takahashi; Wataru Fukui, both of Tokyo, Japan

[73] Assignee: Mitsubishi Denki Kabushiki Kaisha, Tokyo, Japan

[21] Appl. No.: 742,495

[22] Filed: Nov. 1, 1996

[30] Foreign Application Priority Data

Jun. 3, 1996 [JP] Japan ..... 8-140439

[51] Int. Cl.[6] ..... F02P 5/14

[52] U.S. Cl. ..... 123/425

[58] Field of Search ..... 123/425, 434, 123/435; 364/431.08, 431.03; 73/116, 117.3

[56] References Cited

U.S. PATENT DOCUMENTS

| | | | |
|---|---|---|---|
| 5,222,481 | 6/1993 | Morikawa | 123/435 |
| 5,243,942 | 9/1993 | Entenmann et al. | 123/425 |
| 5,386,367 | 1/1995 | Ziegler et al. | 364/431.08 |
| 5,529,040 | 6/1996 | Takeda et al. | 123/425 |
| 5,606,118 | 2/1997 | Muth et al. | 73/116 |
| 5,606,120 | 2/1997 | Daicho et al. | 73/117.3 |
| 5,608,633 | 3/1997 | Okada et al. | 364/431.08 |
| 5,623,412 | 4/1997 | Masson et al. | 364/431.03 |

FOREIGN PATENT DOCUMENTS

| | | | |
|---|---|---|---|
| 4-54283 | 2/1992 | Japan | 123/425 |

*Primary Examiner*—Raymond A. Nelli

*Attorney, Agent, or Firm*—Sughrue, Mion, Zinn, Macpeak & Seas, PLLC

[57] ABSTRACT

A control apparatus for an internal combustion engine capable of optimizing a control parameter for the engine on the basis of information concerning combustion state of the engine by making use of a detected ion current which changes with a high sensitivity in dependence on combustion state within an engine cylinder, for thereby realizing an engine operation control to reduce fuel cost without degrading a control performance for obtaining a high engine output and drivability of a motor vehicle equipped with the engine. The apparatus includes an ion current detecting means (12) for detecting an amount of ions generated within an engine cylinder under control in terms of an ion current (i) immediately after ignition for the engine cylinder, a decision-destined value detecting means (2) for determining a decision-destined value corresponding to a combustion state of the engine cylinder on the basis of a detected value (Ei) of the ion current, and a correction control means (2) for correcting a control parameter for controlling operation of the internal combustion engine when result of comparison of the decision-destined value with a reference value therefor indicates at least one of lowering in output power of the internal combustion engine and degradation in the combustion state in the engine cylinder.

20 Claims, 21 Drawing Sheets

CONTROL METHOD AND APPARATUS FOR INTERNAL COMBUSTION ENGINE

BACKGROUND OF THE INVENTION

1. Field of the Invention

The present invention relates to control method and apparatus for controlling ignition timing and fuel injection in an internal combustion engine by detecting combustion state of the engine on the basis of a change in an ion current generated as a result of combustion of an air-fuel mixture within a cylinder(s) of the engine.

2. Description of Related Art

In general, in the internal combustion engine, an air-fuel mixture is charged into a combustion chamber defined within each of the engine cylinders to be subsequently compressed during a compression stroke by a piston moving reciprocatively within the cylinder. In succession, a high voltage is applied to a spark plug of the cylinder, whereby a spark is generated between electrodes of the spark plug due to electric discharge. Thus, combustion of the compressed air-fuel mixture is triggered. Explosion energy resulting from the combustion is then converted into a movement or stroke of the piston in the direction reverse to that of the compression stroke, which motion is translated into a torque outputted from the internal combustion engine via a crank shaft.

Upon combustion of the compressed air-fuel mixture within the engine cylinder during the explosion stroke, molecules prevailing within the combustion chamber are ionized. Consequently, when a high voltage is applied to an ion current detecting electrode mounted as exposed to the interior of the combustion chamber immediately after the explosion stroke, an amount of ions carrying electric charges can be detected as an ion current.

As is known in the art, the magnitude of ion current varies with a high sensitively in dependence on the combustion state within the combustion chamber. By taking advantage of this phenomenon, the combustion state within the engine cylinder can discriminatively be identified or determined by detecting the state or level of the ion current such as a peak value thereof or the like.

Under the circumstances, there has heretofore been proposed an apparatus for detecting occurrence of misfire in the internal combustion engine on the basis of the level change in the ion current by employing the spark plug as the electrode for detecting the ion current. Such an apparatus is disclosed, for example, in Japanese Unexamined Patent Application Publications Nos. 104978/1990 (JP-A-2-104978) and 54283/1992 (JP-A-4-54283), which may have to be referenced to for more particulars of the conventional misfire detecting apparatus.

The conventional apparatuses such as those disclosed in the publications mentioned above are generally so designed as to decide that the combustion within the engine cylinder is abnormal, as typified by occurrence of the misfire, when the ion current detected immediately after the combustion is of a level lower than a reference value which is previously established for making the decision as to occurrence of the misfire. When abnormality of combustion or misfire is determined in this way, a variety of correction processings for avoiding the abnormality or misfire such as interruption of fuel supply to the engine cylinder suffering the misfire event and others may selectively be resorted to.

With the arrangement of the conventional control apparatus for the internal combustion engine (hereinafter also referred to as the engine control apparatus) mentioned above, occurrence of the misfire can certainly be detected on the basis of the change of the ion current. However, because no consideration is paid to more effective utilization of the detected ion current value for the control of the internal combustion engine, the conventional control apparatus remains to be further improved in particular with regards to optimization of parameters used in controlling the engine operation by detecting the output state of the engine with high accuracy as well as realization of such engine control which allows fuel cost to be reduced without degrading drivability of a load such as a motor vehicle driven by the engine as well as control performance or capability for ensuring a high output power of the engine.

SUMMARY OF THE INVENTION

In the light of the state of the art described above, it is an object of the present invention to provide control method and apparatus for an internal combustion engine which can satisfactorily solve the problems mentioned above.

It is another object of the present invention to provide a control apparatus for an internal combustion engine which can optimize parameter or parameters employed for controlling the operation of the engine by resorting to utilization of detection information of an ion current which changes with a high sensitivity in dependence on the behavior or state of combustion within cylinder(s) of the internal combustion engine.

It is a further object of the present invention to provide a control apparatus for an internal combustion engine which can realize optimization of the control parameter without sacrificing availability of high output performance or capability of the engine and drivability of a load such as a motor vehicle driven by the engine, while ensuring improvement of cost-performance.

More particularly, it is an object of the present invention is to provide a control method for controlling an internal combustion engine, which method is capable of optimizing a parameter or parameters used in controlling operation of the engine on the basis of information concerning combustion state of the engine by making use of a detected ion current which changes with a high sensitivity in dependence on combustion state within the engine cylinder(s), to thereby realize an engine operation control to reduce fuel cost without incurring any appreciable degradation in the control performance while ensuring a high engine output and drivability of a load such as a motor vehicle driven by the engine.

A further object of the present invention is to provide an apparatus for carrying out the control method mentioned above.

In view of the above and other objects which will become apparent as the description proceeds, there is provided according to an aspect of the present invention a control apparatus for an internal combustion engine, which apparatus includes an ion current detecting means for detecting an amount of ions generated within an engine cylinder under control in terms of an ion current immediately after ignition in the engine cylinder, a decision value detecting means for determining a decision value reflecting a combustion state of the engine cylinder on the basis of a detected value of the ion current, and a correction control means for correcting a control parameter for controlling operation of the internal combustion engine when result of comparison of the decision-destined value with a reference value therefor indicates at least either lowering in output power of the internal combustion engine or degradation in the combustion state in the engine cylinder.

By virtue of the arrangement of the engine control apparatus described above, the control parameter for the internal combustion engine can be optimized with high accuracy by using the ion current detection information which changes in dependence on the combustion state and the output state of the engine. Thus, there can be realized a lean-burn control for reducing the fuel cost without incurring either degradation in a maximum output or MBT control (minimum-spark-advance-for-best-torque control) for ensuring a high engine output power or deterioration in the drivability of the motor vehicle driven by the engine equipped with the control apparatus.

In a preferred mode for carrying out the invention, a peak value of the ion current as detected may be used as the aforementioned decision value.

By using the peak value of the ion current signal as the decision-destined value, the combustion state as well as the output state of the internal combustion engine can be determined very effectively with high reliability, to an advantage.

In another preferred mode for carrying out the invention, the ion current detecting means may be so arranged as to include a gain change-over circuit for selectively changing a gain in dependence on the level of the ion current detection value. In that case, the decision value detecting means can determine the peak value as a final decision value on the basis of the ion current detection value and a gain signal supplied from the gain change-over circuit.

With the arrangement mentioned above, the combustion state and the output state of the engine can be determined or identified with simplified structure of the control apparatus.

In yet another preferred mode for carrying out the invention, in which the control parameter is designated for controlling an ignition timing for the engine cylinder, the correction control means may be so designed as to control the ignition timing such that a maximum output power can be obtained from the internal combustion engine when the result of the comparison between the peak value and the reference value given in terms of a reference peak value indicates lowering in the output power of the internal combustion engine.

With the arrangement mentioned above, a minimum-spark-advance-for-best-torque or MBT control can effectively be realized.

Further, in case the control parameter is designated for controlling a fuel injection quantity which determines an air-fuel ratio, the correction control means may be so implemented as to correct the fuel injection quantity such that combustion state of the internal combustion engine can be optimized when the result of the comparison between the peak value and the reference value given in terms of a reference peak value indicates degradation of the combustion state.

The engine control apparatus of the arrangement described above is advantageous in that the lean-burn control of the engine operation can be realized effectively.

In another preferred mode for carrying out the invention, the decision value may be determined on the basis of a peak occurrence time at which a peak occurs in the ion current detection value.

By using the peak occurrence time as the decision value as mentioned above, the combustion state and the output state of the engine can effectively be determined with high accuracy.

In this conjunction, when the control parameter is designated for controlling the ignition timing for the engine cylinder, the correction control means should preferably be so designated as to control the ignition timing such that a maximum output power can be obtained from the internal combustion engine when the result of the comparison between the peak occurrence time and the reference peak occurrence time indicates lowering in output power of the internal combustion engine.

The arrangement described above allows the minimum-spark-advance-for-best-torque or MBT control to be realized effectively.

On the other hand, when the control parameter is destined for controlling a fuel injection quantity which determines an air-fuel ratio, the correction control means should preferably be so implemented as to correct the fuel injection quantity such that combustion state of the internal combustion engine can be optimized when the result of the comparison between the peak occurrence time and the reference peak occurrence time indicates degradation of the combustion state.

The above arrangement equally allows the lean-burn control of the engine to be effected with high efficiency.

In still further preferred mode for carrying out the invention, the decision value may be determined on the basis of a frequency of extreme points occurring in the ion current detection value.

By using the extreme point occurrence frequency of the ion current detection signal as the decision value as mentioned above, it is possible to evaluate the combustion state and the output state of the internal combustion engine with high efficiency.

In a further preferred mode for carrying out the invention, the decision value detecting means may include a frequency component extracting means for extracting frequency components equivalent to extreme-point components from the ion current detection value, a waveform shaping means for shaping the frequency components outputted from the frequency component extracting means into a pulse signal containing pulses corresponding to the frequency components, wherein the extreme point occurrence frequency is determined on the basis of the pulse signal.

By virtue of the arrangement described above, the extreme point occurrence frequency can be determined with high efficiency and reliability.

In this conjunction, when the control parameter may be designated for controlling ignition timing, the correction control means may be so implemented as to control the ignition timing such that a maximum output power can be obtained from the internal combustion engine when the result of the comparison between the extreme point occurrence frequency and reference extreme point occurrence frequency indicates lowering of output power of the internal combustion engine.

The arrangement mentioned above allows the so-controlled MBT control to be effectively realized.

On the other hand, when the control parameter is designated for controlling a fuel injection quantity which determines an air-fuel ratio, the correction control means may be so implemented as to correct the fuel injection quantity such that combustion state of the internal combustion engine can be optimized when the result of the comparison between the extreme point occurrence frequency and the reference extreme point occurrence frequency indicates degradation of the combustion state.

Owing to the arrangement mentioned above, the lean-burn control can effectively be realized.

In yet another preferred mode for carrying out the invention, the decision value may be given in terms of a detection start time at which detection of the ion current is started.

By virtue of the arrangement mentioned above, the combustion state and the output state of the engine can be evaluated very effectively.

In this conjunction, when the control parameter is designated for controlling ignition timing, the correction control means may be so designed as to control the ignition timing such that a maximum output power can be obtained from the internal combustion engine when the result of the comparison between the detection start time of the ion current and reference detection start time indicates lowering of output power of the internal combustion engine.

Thus, the MBT control can effectively be realized.

On the other hand, when the control parameter is designated for controlling a fuel injection quantity which determines an air-fuel ratio, the correction control means may be so implemented as to correct the fuel injection quantity such that combustion state of the internal combustion engine can be optimized when the result of the comparison between the detection start time of the ion current and the reference detection start time indicates degradation of the combustion state.

With the above arrangement, the lean-burn control can be realized effectively.

In still another preferred mode for carrying out the invention, the engine control apparatus mentioned above may further include a means for determining occurrence of knocking in the internal combustion engine. In that case, the correction control means may be comprised of a means for deciding whether or not the internal combustion engine operates in an MBT (minimum-spark-advance-for-best-torque) control operation range so that the correction may be performed such that the ignition timing for the engine cylinder under control is advanced stepwise by a predetermined angle within a range in which the knocking can not take place, when the result of the comparison indicates lowering in the output power of the internal combustion engine beyond a permissible value in the MBT control operation range.

Similarly, the effective MBT control can be realized.

In yet further preferred mode for carrying out the invention, the correction control means may include a means for deciding whether or not the internal combustion engine operates in a fuel-lean operation range. In that case, the correction may be performed such that the fuel injection quantity for the engine cylinder under control is decremented by a predetermined amount, when the result of the comparison indicates a satisfactory combustion state in the fuel-lean operation range of the internal combustion engine, while the fuel injection quantity for the cylinder under control is incremented by a predetermined amount, when the result of the comparison indicates degradation beyond a predetermined value within the fuel-lean operation range of the internal combustion engine.

Equally, there can be realized an effective lean-burn control.

According to another general aspect of the present invention, there is provided a method of controlling operation of an internal combustion engine, which method includes the steps of detecting an ion current generated within an engine cylinder upon combustion of an air-fuel mixture injected in the engine, determining a decision-destined value reflecting state of combustion on the basis of an ion current as detected, averaging a plurality of the decision values determined throughout a predetermined preceding time period to thereby determine a decision reference value, comparing the decision value with the decision reference value, and correcting either a timing for triggering the combustion of the air-fuel mixture or a fuel injection quantity when result of the comparison indicates unsatisfactory combustion state.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
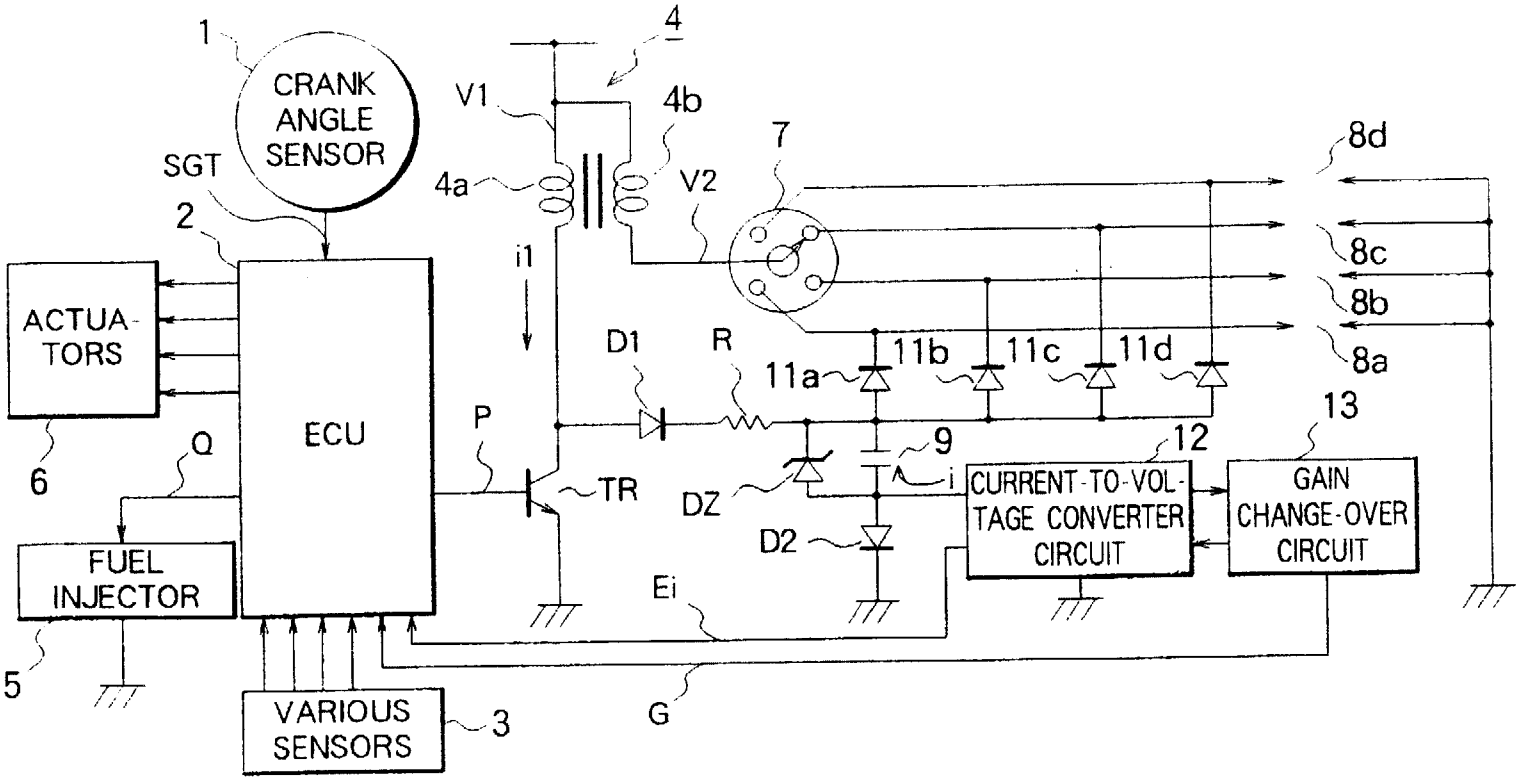
FIG. 1 is a block diagram showing generally a configuration of a control apparatus for an internal combustion engine according to a first embodiment of the present invention.

Now, the present invention will be described in detail in conjunction with what is presently considered as preferred or typical embodiments thereof by reference to the drawings. In the following description, like reference characters designate like or equivalent components parts throughout the several views.

Embodiment 1

Figure 2:
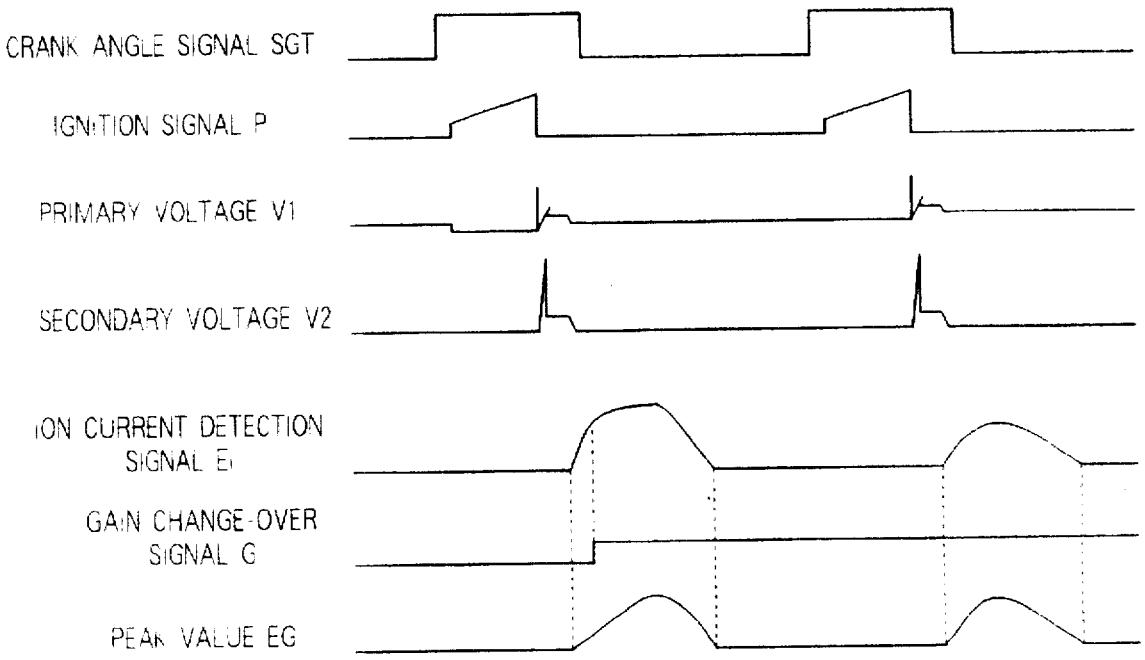
FIG. 2 is a timing chart illustrating operation of the engine control apparatus according to the first embodiment of the invention.

FIG. 1 is a block diagram showing generally a configuration of a control apparatus for an internal combustion engine according to a first embodiment of the invention, wherein it is assumed that a high voltage is applied distributively to ignition or spark plugs of the individual engine cylinders, respectively, by way of a distributor. Further, FIG. 2 is a timing chart showing waveforms of signals (voltages) appearing in the arrangement shown in FIG. 1 on the assumption that the air-fuel mixture undergoes normal combustion within the individual engine cylinders.

Now referring to FIG. 1, provided in association with a crank shaft (not shown) of an internal combustion engine (not shown either and hereinafter referred to also as the engine) is a crank angle sensor 1 which is adapted to output a crank angle signal SGT containing a number of pulses at a frequency which depends on a rotation number or speed (rpm) of the engine.

The leading edges of the pulses contained in the crank angle signal SGT indicate angular reference positions for the individual engine cylinders in terms of crank angles, respectively. The crank angle signal SGT is supplied to an electronic control unit 2 which may be constituted by a microcomputer, to be utilized for various controls and arithmetic operations therefor, as will be described later on.

The electronic control unit 2 is so programmed as to generate an ignition signal P to be applied to a power transistor TR for driving an ignition coil 4, a fuel injection signal Q applied to each of fuel injectors 5 provided in association with the individual engine cylinders, respectively, and driving signals supplied to a variety of actuators generally designated by a reference character 6 and provided for a throttle valve, an ISC valve and others, respectively, on the basis of the crank angle signal SGT outputted from the crank angle sensor 1 and the engine operation information signals obtained from the various sensors 3 such as an intake air sensor, a throttle position sensor and others which are known per se.

The ignition signal P outputted from the electronic control unit 2 is applied to a base of the power transistor TR for turning on/off the latter. More specifically, the power transistor TR is turned off in response to the ignition signal P, whereby a primary current il flowing through a primary winding 4*a* of the ignition coil 4 is interrupted. As result of this, a primary voltage V1 appearing across the primary winding 4*a* rises up steeply, whereby a secondary voltage V2 having a high voltage level (several ten kilovolts) is induced in the secondary winding 4*b* of the ignition coil 4.

A distributor 7 connected to one output terminal of the secondary winding 4*b* distributes the secondary voltage V2 to spark plugs 8*a*, . . . , 8*d*, whereby spark discharges take place within combustion chambers defined in the associated engine cylinders, respectively, to trigger combustion of the air-fuel mixture confined within the combustion chamber of each cylinder.

Inserted between one end of the primary winding 4*a* of the ignition coil 4 and the ground is a series circuit composed of a rectifier diode D1, a current limiting resistor R, a voltage limiting Zener diode DZ and a rectifier diode D2, wherein the series circuit constitutes a charging current path leading to a power source for detecting an ion current. The power source may be constituted by a capacitor, as mentioned below.

Connected in parallel between both ends of the Zener diode DZ is a capacitor 9 which is charged to a predetermined level by a charging current and serves as the power source for detecting the ion current, as mentioned above. The capacitor 9 is discharged immediately after the ignition control process, allowing an ion current i to flow therethrough.

Inserted between one end of the capacitor 9 and one terminals of the spark plugs 8*a*, . . . , 8*d* are diodes 11*a*, . . . , 11*d*, respectively, while a current-to-voltage converter circuit 12 is inserted between the other end of the capacitor 9 and the ground potential, wherein each of the diodes 11*a*, . . . , 11*d* and the current-to-voltage converter circuit 12 cooperate with the capacitor 9 to constitute an ion current detecting means through which the ion current i can flow.

The current-to-voltage converter circuit 12 incorporates a current detecting resistor (not shown) for converting the ion current i into a corresponding voltage which is outputted as an ion current detection voltage signal Ei from the current-to-voltage converter circuit 12 to be supplied to the electronic control unit 2. A gain change over circuit 13 is provided in combination with the current-to-voltage converter circuit 12 for adjusting a level for the voltage conversion performed by the current-to-voltage converter circuit 12 in accordance with a level of the ion current i. To say in another way, the gain change-over circuit 13 serves for adjusting the gain of the current-to-voltage counter circuit 12 in dependence on the level of the ion current. A gain change-over signal G indicating a currently effective gain value, of gain is generated by the gain change-over circuit 13 to be inputted to the electronic control unit 2.

Figure 3:
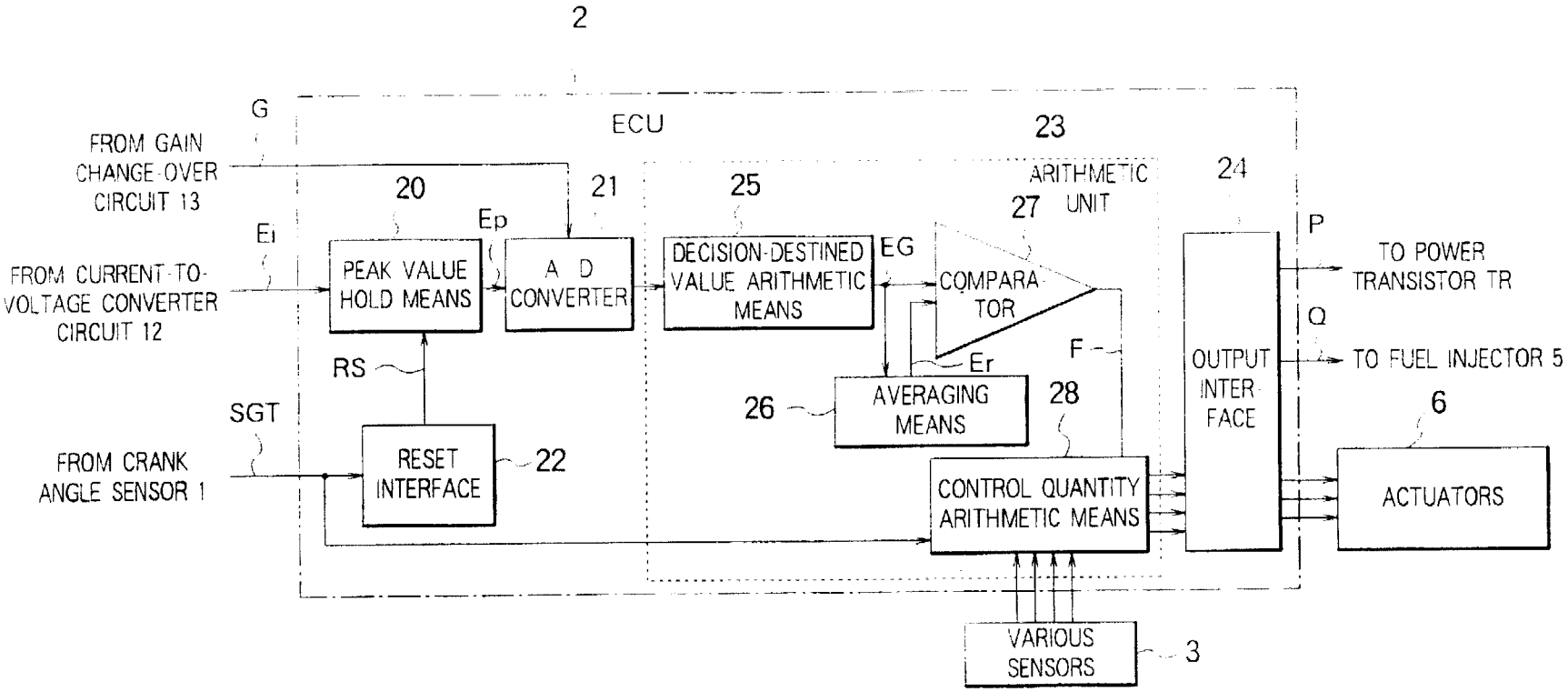
FIG. 3 is a functional block diagram showing a structure of an electronic control unit incorporated in the engine control apparatus according to the first embodiment of the invention.

FIG. 3 is a functional block diagram showing an exemplary configuration of the electronic control unit 2 employed in the engine control apparatus shown in FIG. 1. The electronic control unit 2 is so designed that the combustion state can discriminatively be determined or identified on the basis of the ion current detection signal Ei and the gain change-over signal G.

Now referring to FIG. 3, the electronic control unit 2 is comprised of a peak value hold means 20 for holding a peak value Ep of the ion current detection signal Ei, an analogue-to-digital or A/D converter 21 for converting the peak value Ep and the gain change-over signal G into digital signals, respectively, a reset interface (also referred to as the reset I/F) 22 for outputting a reset signal RS to the peak value hold means 20 in response to the crank angle signal SGT, an arithmetic unit 23 constituted by a central processing unit or CPU for short, and an output interface (also referred to as the output I/F) 24 for outputting various control parameters arithmetically determined by the arithmetic unit 23.

Further referring to FIG. 3, the arithmetic unit 23 is composed of a decision value arithmetic means 25 for determining a peak value EG to be used as a final decision value on the basis of a product of the peak value Ep of the current and the gain change-over signal G as inputted from the A/D converter 21, an averaging means 26 for determining a reference peak value Er on the basis of a mean value of the peak values EG detected over a predetermined preceding period, a comparator 27 for comparing the decision peak value EG outputted from the arithmetic means 25 with the reference peak value Er outputted from the averaging means 26, to thereby output a comparison result signal F, and a control quantity arithmetic means 28 for arithmetically determining various control parameters (e.g. ignition timing, fuel injection quantity, etc.) on the basis of the crank angle signal SGT outputted from the crank angle sensor 1 and indicating the crank angle positions for every cylinders and engine operation information signals obtained from the various sensors designated en bloc by reference numeral 3 in FIGS. 1 and 3, while correcting the control parameters by taking into account the comparison result indication signal F mentioned above.

Now, referring to FIG. 2 along with FIG. 1, operation in general of the engine control apparatus according to the instant embodiment of the invention will be described.

First referring to FIG. 1, the crank angle sensor 1 outputs the crank angle signal SGT (see FIG. 2) having a pulse waveform which depends on the rotation number or speed (rpm) of the internal combustion engine, while the electronic control unit 2 generates various driving signals such as, for example, the ignition signal P for turning on/off the power transistor TR as mentioned hereinbefore, on the basis of the crank angle signal SGT indicating the crank angle positions of the individual engine cylinders, respectively, and the engine operation state signals derived from the sensors 3.

The power transistor TR assumes an electrically conducting state when the ignition signal P is at a high or "H" level to thereby allow the primary current il to flow through the primary winding 4*a* of the ignition coil 4. When the ignition signal P changes from the high or "H" level to a low or "L" level, the primary current il flowing through the primary winding 4*a* of the ignition coil 4 is interrupted.

Upon interruption of the primary current il, the primary voltage V1 appears across the primary winding 4*a*, as a result of which the capacitor 9 is charged by way of the charging current path constituted by the rectifier diode D1, the current limiting resistor R and the rectifier diode D2. Needless to say, charging of the capacitor 9 comes to an end when the voltage appearing across the capacitor 9 has reached a reverse or backward breakdown voltage of the Zener diode DZ.

On the other hand, there is induced the secondary voltage V2 of several ten kilovolts in the secondary winding 4*b* of the ignition coil 4 upon interruption of the primary current il. This secondary voltage V2 is applied distributively to the spark plugs 8*a*, . . . , 8*d* of the individual engine cylinders, respectively, by way of the distributor 7, which results in generation of the spark discharge each of the combustion chambers of the engine cylinders, whereby the air-fuel mixture undergoes combustion.

Upon combustion of the air-fuel mixture, ions are generated within the combustion chamber of the engine cylinder. Thus, the ion current i can flow to the capacitor 9 which is charged to the voltage level corresponding to the breakdown voltage of the Zener diode DZ and which serves as a power source. By way of example, let's assume that combustion of the air-fuel mixture takes place within the combustion chamber of the engine cylinder equipped with the spark plug 8*a*. Then, the ion current i flows along a current path extending from the capacitor 9 to the current-to-voltage converter circuit 12 through the diode 11*a* and the spark plug 8*a* in this order. At that time, the current-to-voltage converter circuit 12 converts the ion current i into a voltage signal which is outputted as the ion current detection signal Ei to be supplied to the electronic control unit 2.

On the other hand, the gain change-over circuit 13 which cooperates with the current-to-voltage converter circuit 12 changes over the gain for the current-to-voltage conversion in dependence on the voltage level of the ion current detection signal Ei, whereby the gain change-over signal G indicating the currently effective gain is inputted to the electronic control unit 2.

At this juncture, it should be mentioned that a plurality of different levels are set for the gain change-over signal G, wherein every time the gain is decremented by one level, the voltage signal outputted from the current-to-voltage converter circuit 12 is incremented by a predetermined value.

Referring to FIG. 2, there is illustrated such state in which the gain is decremented by one step or level when the voltage level of the ion current detection signal Ei has attained a preset level (see broken lines), whereby the current-to-voltage conversion ratio for the ion current detection signal Ei is decremented correspondingly by the gain change-over circuit 13. In this case, the voltage of the gain change-over signal G increments by a predetermined value.

On the contrary, when the voltage level of the ion current detection signal Ei becomes lower than a predetermined level (not illustrated) which is lower than the predetermined or preset level mentioned previously, the gain change-over circuit 13 increments the gain for the current-to-voltage conversion by one step or level.

Figure 4:
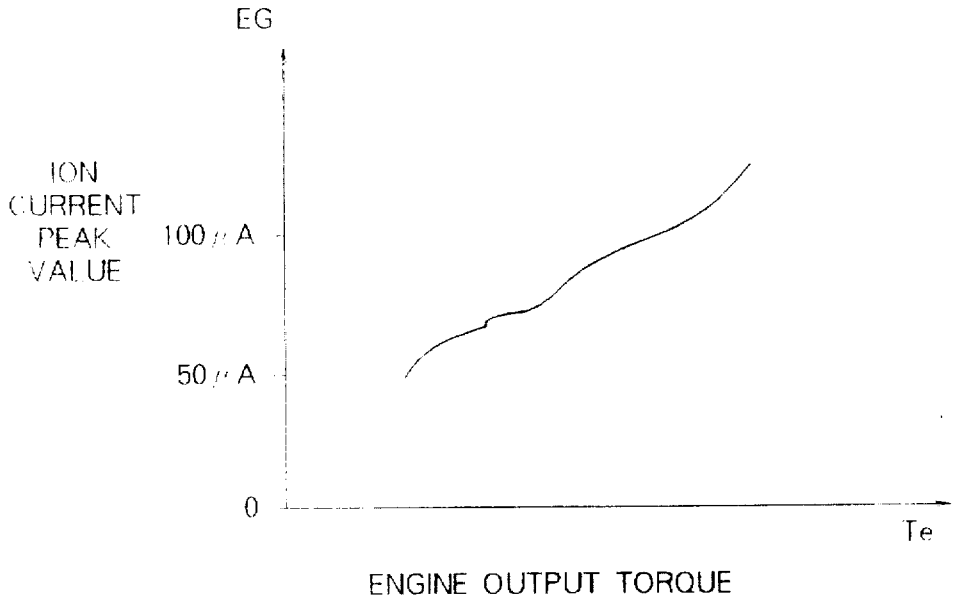
FIG. 4 is a characteristic diagram for graphically illustrating a relation between a peak value of an ion current and an engine output torque.

Next, correction processing operation of the engine control apparatus according to the instant embodiment of the invention shown in FIGS. 1 and 3 will be described by reference to FIGS. 4 to 6 along with FIG. 2, wherein FIG. 4 is a characteristic diagram for graphically illustrating a relation between the peak value EG of the ion current i and an engine output torque Te (which bears at least approximately a correlation to the combustion state). As can be seen in the figure, the engine output torque Te increases, indicating that the combustion state is improved, as the peak value EG becomes higher within a range of the ion current i from 50 μA to 150 μA.

Figure 5:
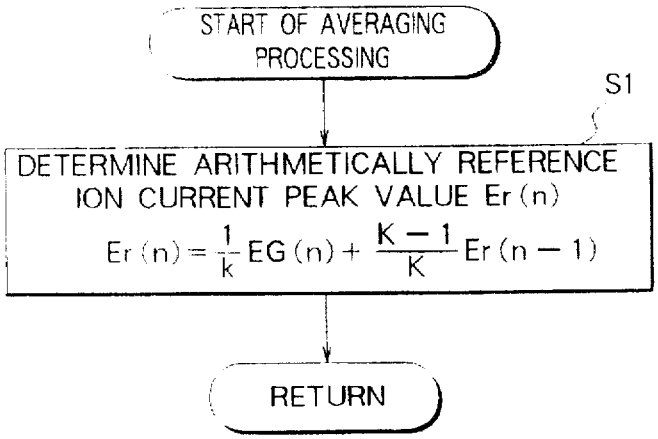
FIG. 5 is a flow chart for illustrating a processing executed by an averaging means for determining a reference peak value according to the first embodiment of the invention.

FIG. 5 is a flow chart for illustrating the averaging operation performed by the averaging means 26 and shows an averaging routine for determining the reference peak value Er. Further, FIG. 6 is a flow chart for illustrating operations of the comparator 27 and the control quantity arithmetic means 28 and shows a comparison/correction processing routine for correcting the control parameters on the basis of the comparison result indication signal F. Parenthetically, in the case of the engine control apparatus according to the instant embodiment of the present invention, it is assumed that the sensors 3 include a knocking sensor (not shown) and that the electronic control unit 2 incorporates a means or facility for making decision concerning occurrence of knocking in the engine, wherein the ignition timing is so controlled as to be delayed upon occurrence of knocking for thereby suppressing the knock event.

The arithmetic unit 23 incorporated in the electronic control unit 2 serves not only for arithmetically determining the ignition timing and the fuel injection quantity on the basis of the crank angle signal SGT and the engine operation state signals supplied from the sensors 3 to thereby output the ignition signal P and the fuel injection signal Q but also generating as output signals the ignition signal P and the fuel injection signal Q corrected finally on the basis of the peak value EG determined arithmetically from the ion current detection signal Ei and the gain change-over signal G.

More specifically, of the gain change-over signal G and the ion current detection signal Ei inputted to the electronic control unit 2, the peak value Ep of the ion current detection signal Ei is detected and held by the peak value hold means 20, whereon the peak value Ep is converted into a digital signal together with the gain change-over signal G by means of the A/D converter 21.

At that time, when the crank angle signal SGT is at the "H" level, the reset interface 22 masks the peak value hold means 20, while outputting the reset signal RS for validating the peak value hold means 20 when the crank angle signal SGT is at the "L" level. Thus, the peak value hold means 20 is reset when the crank angle signal SGT is at the "H" level and thus holds the peak value Ep only during the period in which the crank angle signal SGT is at the "L" level.

The gain change-over signal G and the peak value Ep undergone the digital conversion through the A/D converter 21 are then multiplied each other by the decision value arithmetic means 25 constituting a part of the arithmetic unit 23 as mentioned previously, whereby a final decision value, i.e., the peak value EG reflecting the gain indicated by the gain change-over signal G can be obtained.

Because the voltage level of the ion current detection signal Ei becomes low as a function of the gain change-over signal G, as can be seen in FIG. 2, the actual or real peak value EG can be obtained by multiplying the peak value Ep held initially by the gain indicated by the gain change-over signal G.

The averaging means 26 serves for averaging the peak values EG over a predetermined period in the past (see FIG. 5). More specifically, with the aid of the averaging means 26, a current reference peak value Er(n) is determined on the basis of the current peak value EG(n) and the preceding reference peak value Er(n−1) in accordance with the following expression (1) (step S1):

$$Er(n)=EG(n)/K+Er(n-1)\times(K-1)/K \quad (1)$$

where coefficient K represents the number of data in the past to be subjected to the averaging processing.

Figure 6:
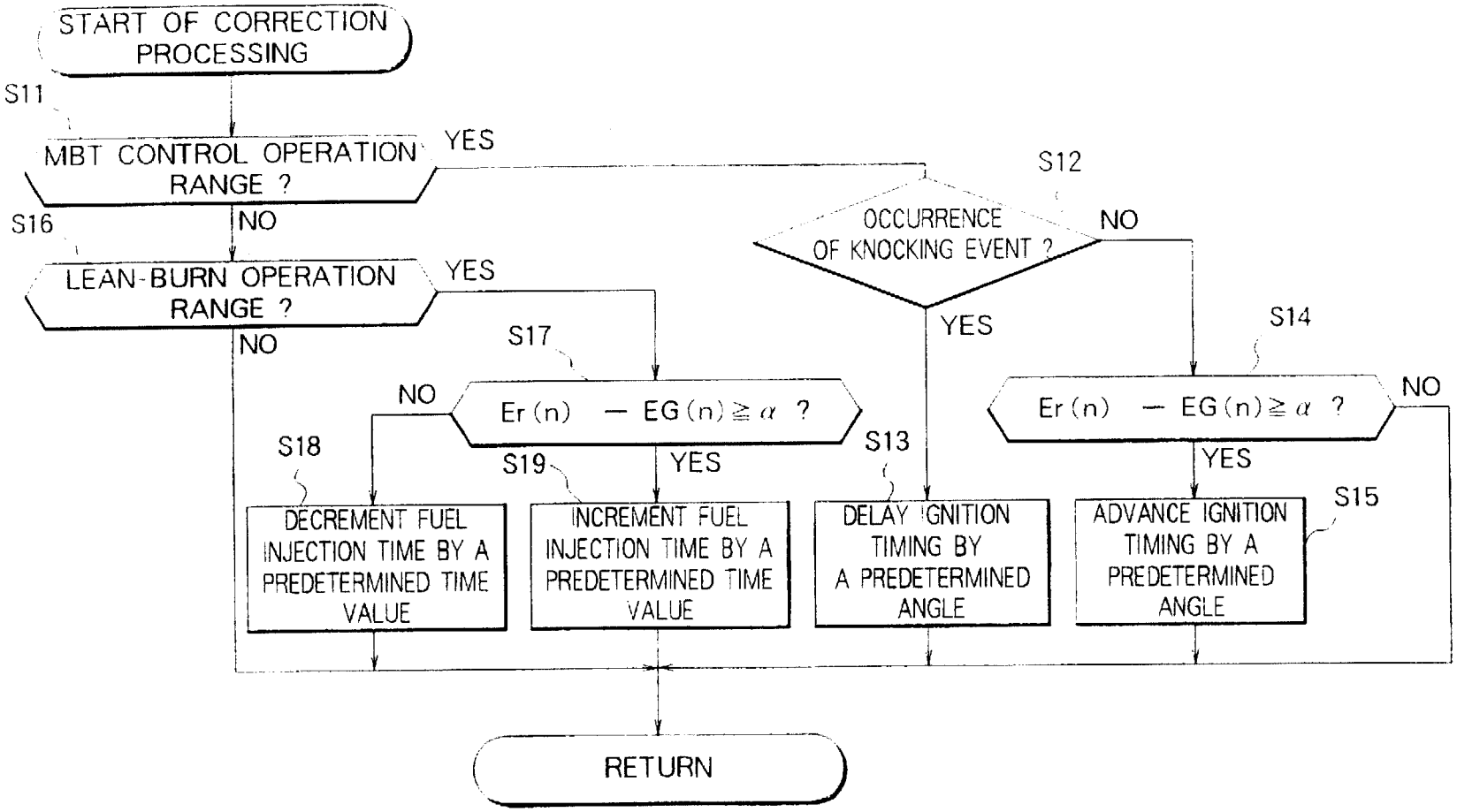
FIG. 6 is a flow chart for illustrating comparison/correction processing operation effected by the engine control apparatus according to the first embodiment of the invention.

Upon completion of the averaging routine (FIG. 5), the arithmetic unit 23 then executes comparison/correction processing routine illustrated in FIG. 6.

Referring to FIG. 6, it is first decided in a step S11 on the basis of the operation state information derived from the outputs of the various sensors 3 whether or not the current engine operation control state lies within a minimum-spark-advance-for-best-torque or MBT (maximum engine output) control operation range. When the answer of this decision step S11 is affirmative "YES", decision is then made as to occurrence of knocking event in a step S12.

When it is decided in the step S12 that the knocking event is taking place (i.e., when the step S12 results in "YES"), the ignition timing is delayed by a time corresponding to a preset crank angle for suppressing the knocking angle in a step S13, to thereby prevent the knock, whereupon the processing leaves the routine illustrated in FIG. 6.

By contrast, when it is decided that knocking event is not occurring (i.e., when the answer of the decision step S12 is negative "NO"), then the comparator 27 compares the reference peak value Er(n) obtained from the averaging process according to the expression (1) with the peak value EG(n) detected currently, to thereby make decision whether or not difference between both the aforementioned values Er(n) and EG(n) is equal to or greater than a permissible value α, indicating incomplete combustion state, by checking whether the condition given by the following expression (2) is satisfied or not (step S14):

$$Er(n)-EG(n)\geqq\alpha \quad (2)$$

The comparator 27 then outputs a signal indicating the result of comparison performed as to whether the condition given by the expression (2) has been satisfied or not as the comparison result indication signal F mentioned hereinbefore to the control quantity arithmetic means 28.

Unless the condition given by the expression (2) is satisfied (i.e., when the condition that $Er(n)-EG(n)<\alpha$ is met (with the answer of the comparison decision step S14 being negative "NO"), this means that the peak value of the ion current is sufficiently large to ensure full availability of the engine output torque Te, as can be seen from FIG. 4.

Consequently, the control quantity arithmetic means 28 regards the peak value EG as indicating the normal combustion state. Thus, the processing leaves the routine shown in FIG. 6 without correcting the engine control quantity such as the ignition timing and/or fuel injection quantity.

On the other hand, when it is decided in the step S14 that the condition defined by the expression (2) is satisfied (i.e., when the decision step S14 results in affirmation "YES"), this means that the ion current peak value EG decreases with the engine output torque Te becoming lower (due to degradation in the combustion state). Accordingly, the ignition signal P is so corrected that the ignition timing advances by a predetermined angle, to thereby obtain a maximum engine output (step S15), whereupon the processing leaves the routine shown in FIG. 6.

The correction processing for advancing the ignition timing mentioned above is repetitively executed by a predetermined angle until the answer of the decision step S11 results in negation, indicating that the combustion state is improved.

Turning back to the step S11, when it is decided that the current engine operation control state is not in the maximum engine output or MBT (minimum spark advance for best torque) operation range (i.e., when the answer of the step S11 is "NO"), then decision is made in a step S16 as to whether or not the current operation control state falls within a so-called lean-burn operation range (i.e., engine operation range in which fuel is lean).

When it is decided that the current control state is outside of the lean-burn operation range (i.e., when the answer of the step S16 is "NO"), this means that the fuel is supplied sufficiently with the fuel injection time being sustained adequately in the current engine operation state. Accordingly, the control quantity arithmetic means 28 performs no correction for the fuel injection quantity. Thus, the processing leaves the routine shown in FIG. 6 without performing any correction of the control parameter (i.e., the fuel injection quantity in this case).

On the contrary, when it is decided in the step S16 that the engine operation state lies within the lean-burn operation range (i.e., when the answer of the step S16 is "YES"), then decision is made in a step S17 as to whether the condition given by the expression (2) is satisfied or not, as described previously in conjunction with the step S14.

When it is decided in the step S17 that $Er(n)-EG(n)<\alpha$ i.e., when the answer of the decision step S17 is "NO", this means that the combustion state is satisfactory (i.e., it falls within a permissible range of tolerance). Accordingly, the fuel injection signal Q is so corrected in a step S18 that the fuel injection time is reduced by a predetermined time value (and hence the fuel injection quantity decreases by a predetermined amount) with a view to reducing the fuel cost by realizing a lean-burn operation state (i.e., state where air-fuel mixture undergoing the combustion is lean), whereupon the processing leaves the routine shown in FIG. 6.

On the other hand, when it is decided in the step S17 that the condition given by the expression (2) is satisfied (i.e., when the answer of the step S17 is "YES"), this means that the combustion state is unsatisfactory or unacceptable. Accordingly, the fuel injection time is incremented by a predetermined time (i.e., the fuel injection quantity is incremented by a predetermined amount, to say in another way), in a step S19 in order to ensure a maximum engine output power by optimizing the combustion state, whereupon the processing leaves the routine illustrated in FIG. 6.

The above-mentioned correction processing for increasing the fuel injection quantity or amount is repetitively performed until the decision step S17 results in negation "NO", indicating that the combustion state has been improved.

As will now be understood from the foregoing description, when the difference between the current peak value EG(n) and the reference peak value Er(n) obtained by averaging the peak values in the past over a predetermined period becomes equal to or greater than the permissible value $\alpha$, indicating degradation of the combustion state, the correction processing for advancing the ignition timing (step S15) or for increasing the fuel injection quantity (step S19) is executed to thereby optimize the combustion state of the engine. Thus, there can be ensured a maximum output torque of the internal combustion engine.

At this juncture, it should be mentioned that the predetermined angle by which the ignition timing is advanced for improving the combustion state in the step S15 as well as the predetermined time value by which the fuel injection time or duration is elongated for correcting the combustion state by incrementing the fuel injection quantity in the step S19 should preferably be set at relatively small increment/decrement values, respectively, so that fine adjustment of the ignition timing and the fuel injection quantity can be realized.

Embodiment 2

In the case of the engine control apparatus according to the first embodiment of the invention, the ion current detection signal Ei and the gain change-over signal G are multiplied by each other in order to determine a final peak value EG. In this conjunction, it is however noted that when the gain change-over signal G is divided sufficiently finely, it is possible to determine the decision value with satisfactory accuracy on the basis of only the gain change-over signal G. The second embodiment of the invention is directed to the processing for determining the decision value on the basis of only the gain change-over signal G.

Figure 7:
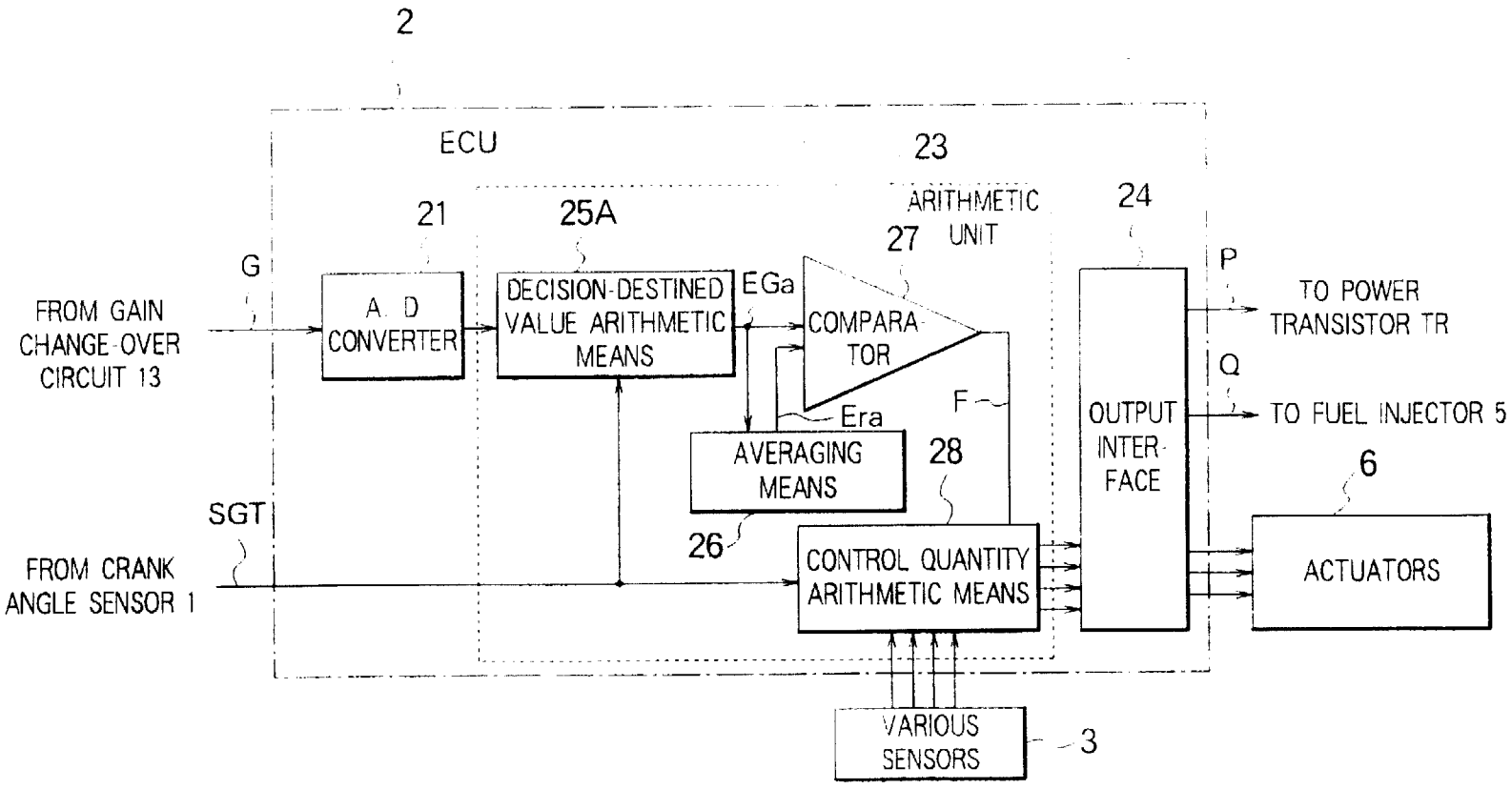
FIG. 7 is a functional block diagram showing a structure of an electronic control unit according to a second embodiment of the present invention.

FIG. 7 is a functional block diagram showing a structure of the electronic control unit 2 which is so designed or programmed as to realize with ease the control or correction of the combustion state of the engine on the basis of only the gain change-over signal G. As can be seen in the figure, the electronic control unit 2 according to the second embodiment of the invention is essentially similar to that of the first embodiment except that the peak value hold means 20 and the reset interface 22 (see FIG. 3) are spared.

Referring to FIG. 7, the A/D converter 21 converts only the gain change-over signal G to a digital signal, while the decision-destined value arithmetic means 25A outputs the gain change-over signal G undergone the digital conversion as a decision value EGa.

The decision value arithmetic means 25A is reset softwarewise internally of the arithmetic unit 23 when the crank angle signal SGT is at an "H" level. Accordingly, the decision value EGa based solely on the gain change-over signal G is fetched to be held only when the crank angle signal SGT is at an "L" level. In that case, the reset interface 22 shown in FIG. 3 can be spared because the crank angle signal SGT serves as the reset signal.

On the other hand, the averaging means 26 is so designed as to output a decision reference value Era which is determined by averaging the decision values EGa over a predetermined number of cycles, while the comparator 27 compares the decision value EGa with the decision reference value Era to thereby output the comparison result indication signal F. The control quantity arithmetic means 28 in turn corrects the value of the control parameters such as the ignition timing or the fuel injection quantity for thereby optimizing the engine operation on the basis of the comparison result indication signal F in such a manner as described previously by reference to FIG. 6. In this way, a maximum engine output torque Te can be ensured.

Embodiment 3

In the case of the engine control apparatus according to the first embodiment of the present invention, the peak value EG of the ion current i is used as the decision value in making decision as to the combustion state of the engine cylinder. It should however be mentioned that the timing or time point at which the peak of the ion current detection signal Ei takes place bears a relation to the combustion state of the engine. By taking into account this fact, the time at which the peak occurs in the ion current detection signal Ei (hereinafter referred to also as the peak occurrence time) can be used as the decision value.

Figure 8:
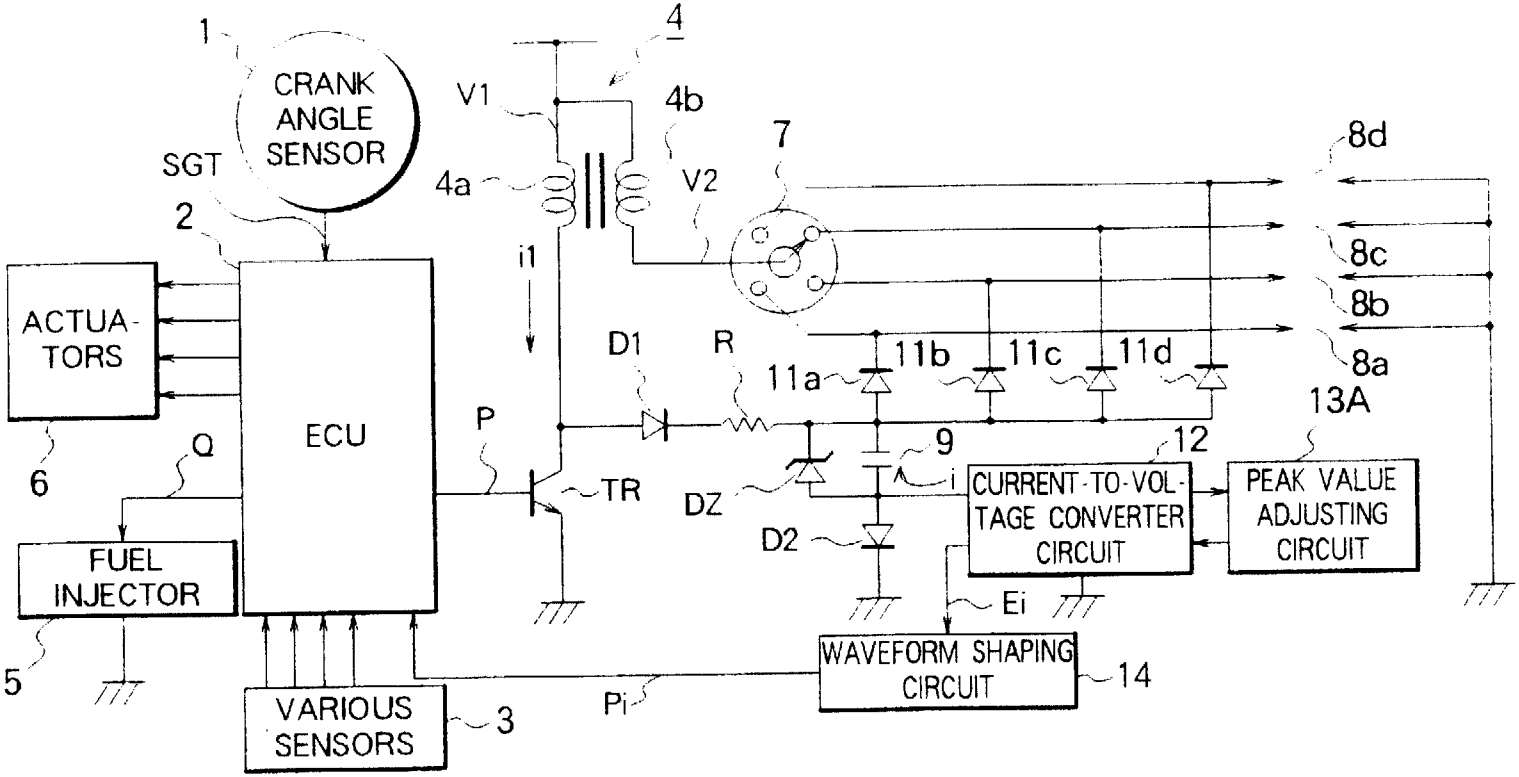
FIG. 8 is a block diagram showing schematically and generally a basic structure of an engine control apparatus according to a third embodiment of the present invention.
Figure 9:
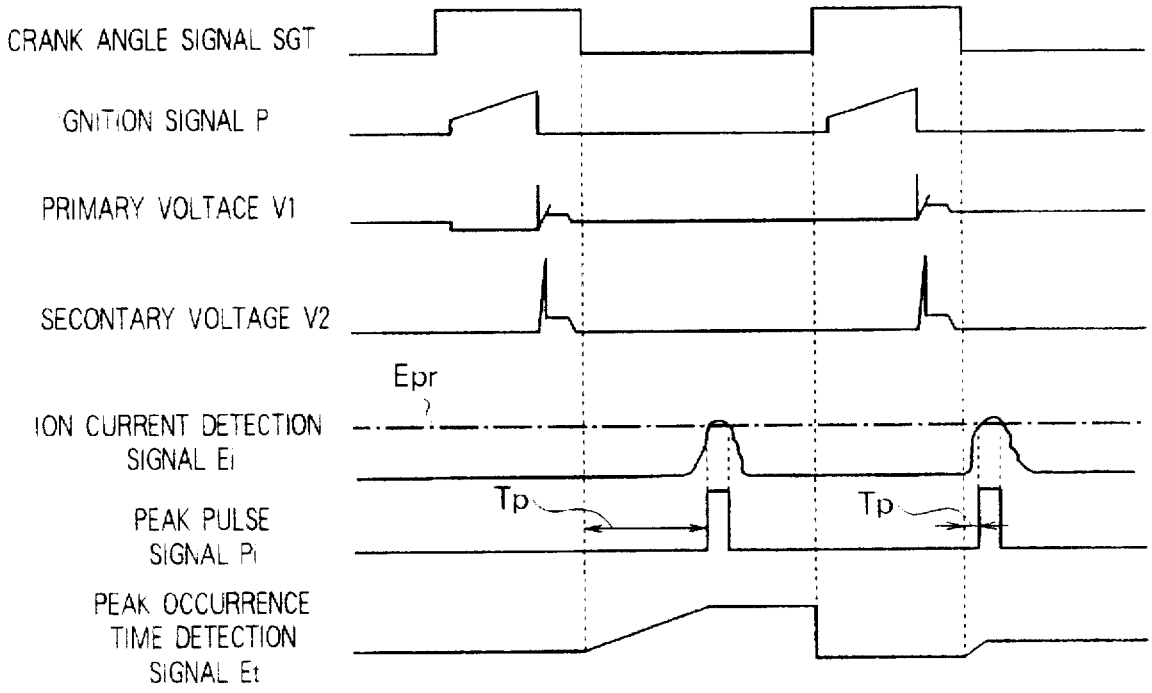
FIG. 9 is a timing chart for illustrating operations of the engine control apparatus according to the third embodiment of the invention.
Figure 10:
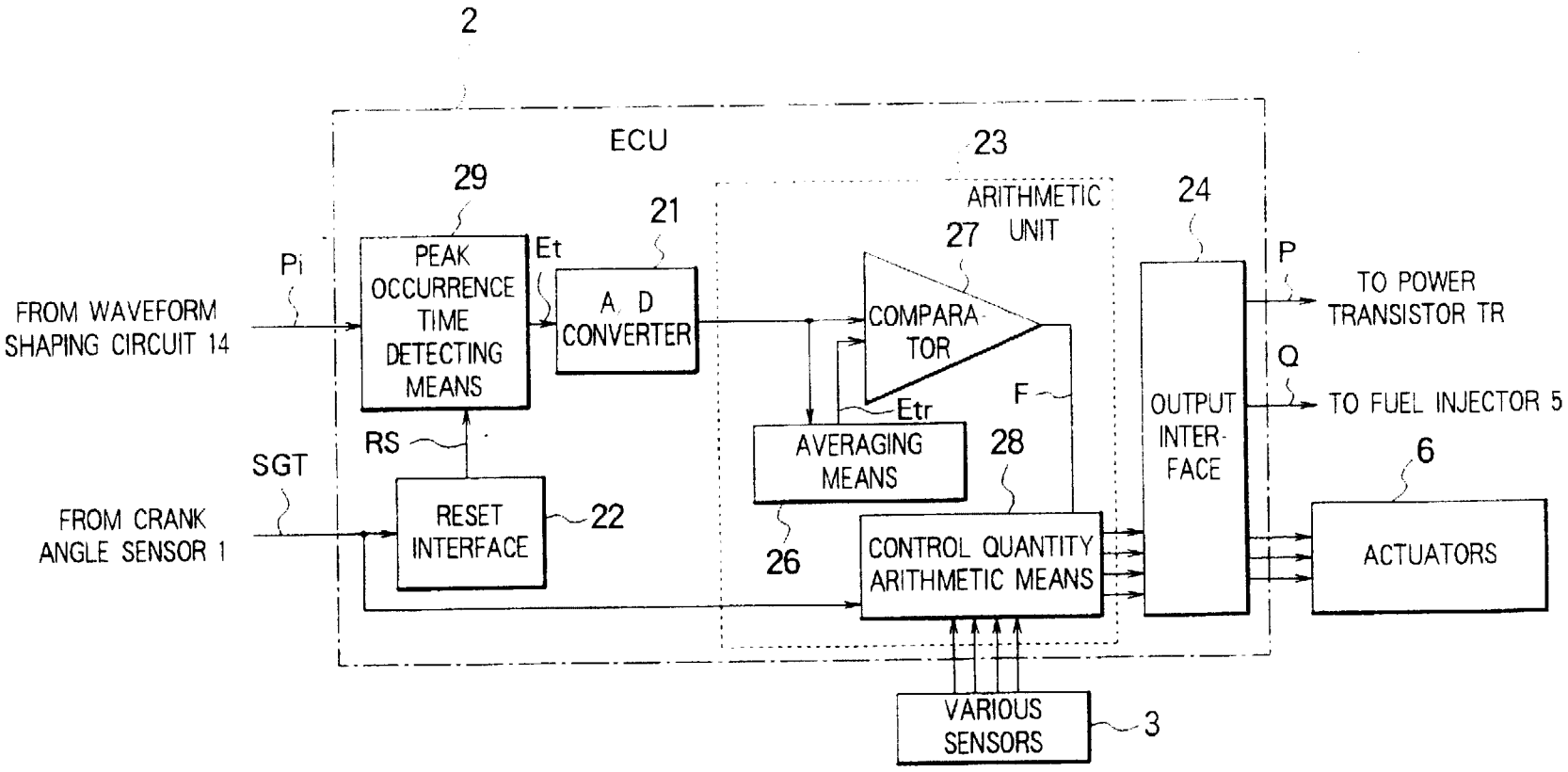
FIG. 10 is a functional block diagram showing a structure of an electronic control unit incorporated in the engine control apparatus according to the third embodiment of the invention.

FIG. 8 is a block diagram showing schematically and generally a basic structure of the engine control apparatus according to a third embodiment of the present invention in which the time at which the peak occurs in the ion current detection signal (voltage signal) Ei is used as the decision value in making decision concerning the combustion state. Further, FIG. 9 is a timing chart for illustrating waveforms of various signals generated in operation of the engine control apparatus shown in FIG. 8 on the assumption that combustion state is improved in a succeeding combustion cycle. Additionally, FIG. 10 is a functional block diagram showing an exemplary configuration of the electronic control unit (ECU) 2 incorporated in the engine control apparatus shown in FIG. 8.

Now, description will be made of the engine control apparatus according to the instant embodiment of the invention by reference to FIG. 8 in which those components described hereinbefore in conjunction with FIG. 1 are denoted by like reference characters and repetitive description thereof will be omitted.

A peak value adjusting circuit 13A cooperates with the current-to-voltage converter circuit 12 to adjust the voltage level of the ion current detection signal (voltage signal) Ei more finely than the gain change-over circuit 13 mentioned hereinbefore (see FIG. 1) so that the peak value of the ion current detection signal Ei can be maintained substantially constant at every ignition timing.

A waveform shaping circuit 14 inserted at the output side of the current-to-voltage converter circuit 12 serves to compare the ion current detection signal Ei with a predetermined reference voltage Epr corresponding to a peak level (see FIG. 9) to thereby shape the waveform of the ion current detection signal Ei. The output of the waveform shaping circuit 14 is supplied to the electronic control unit 2 as a peak pulse Pi.

Referring to FIG. 9, a time span between a time point at which the crank angle signal SGT falls and a time point at which the peak pulse Pi rises is represented by Tp and referred to as the peak occurrence time, a voltage signal obtained by converting the peak occurrence time Tp to a voltage is represented by Et and referred to as the peak occurrence time detection signal, a value obtained by averaging the peak occurrence time detection signals Et is referred to as a reference peak occurrence time signal Etr.

Next, description will turn to a configuration of the electronic control unit by reference to FIG. 10 in which components like as or functional equivalent to those described hereinbefore in conjunction with FIG. 3 are denoted by like reference characters and repeated description thereof will be omitted.

A peak occurrence time detecting means 29 incorporated in the electronic control unit 2 functions to convert the peak occurrence time Tp intervening between the falling edge of the crank angle signal SGT and the rising edge of the peak pulse Pi into a voltage signal referred to as the peak occurrence time detection signal Et which is then inputted to the comparator 27 constituting a part of the arithmetic unit 23 via the A/D converter 21.

On the other hand, the averaging means 26 averages the peak occurrence time detection signals generated during a predetermined period Et to thereby generate the reference peak occurrence time signal Etr by executing a processing routine similar to that described hereinbefore by reference to FIG. 5. The reference peak occurrence time signal Etr is then applied to a reference input terminal of the comparator 27. Thus, the comparator 27 compares the peak occurrence time detection signal Et with the reference peak occurrence time signal Etr to output the comparison result indication signal F reflecting the combustion state. The comparison result indication signal F is then supplied to the control quantity arithmetic means 28.

In that case, because the peak occurrence time detecting means 29 is reset by the reset signal RS issued by the reset interface 22 over a period during which the crank angle signal SGT is at a high level, the comparator 27 compares the current peak occurrence time detection signal Et with the reference peak occurrence time signal Etr obtained by averaging the preceding peak occurrence time detection signals Et over a predetermined period in the past to thereby make decision as to appropriateness of the peak occurrence time detection signal Et only during a period in which the crank angle signal SGT is at a low or an "L" level.

Figure 11:
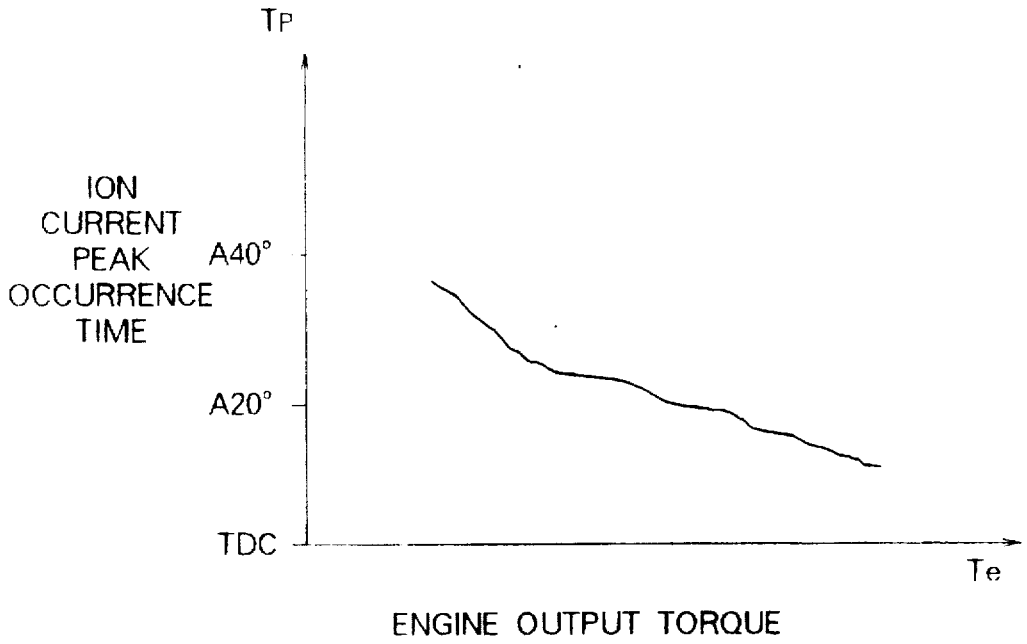
FIG. 11 is a characteristic diagram for illustrating graphically a relation between a peak occurrence time of an ion current and an engine output torque.
Figure 12:
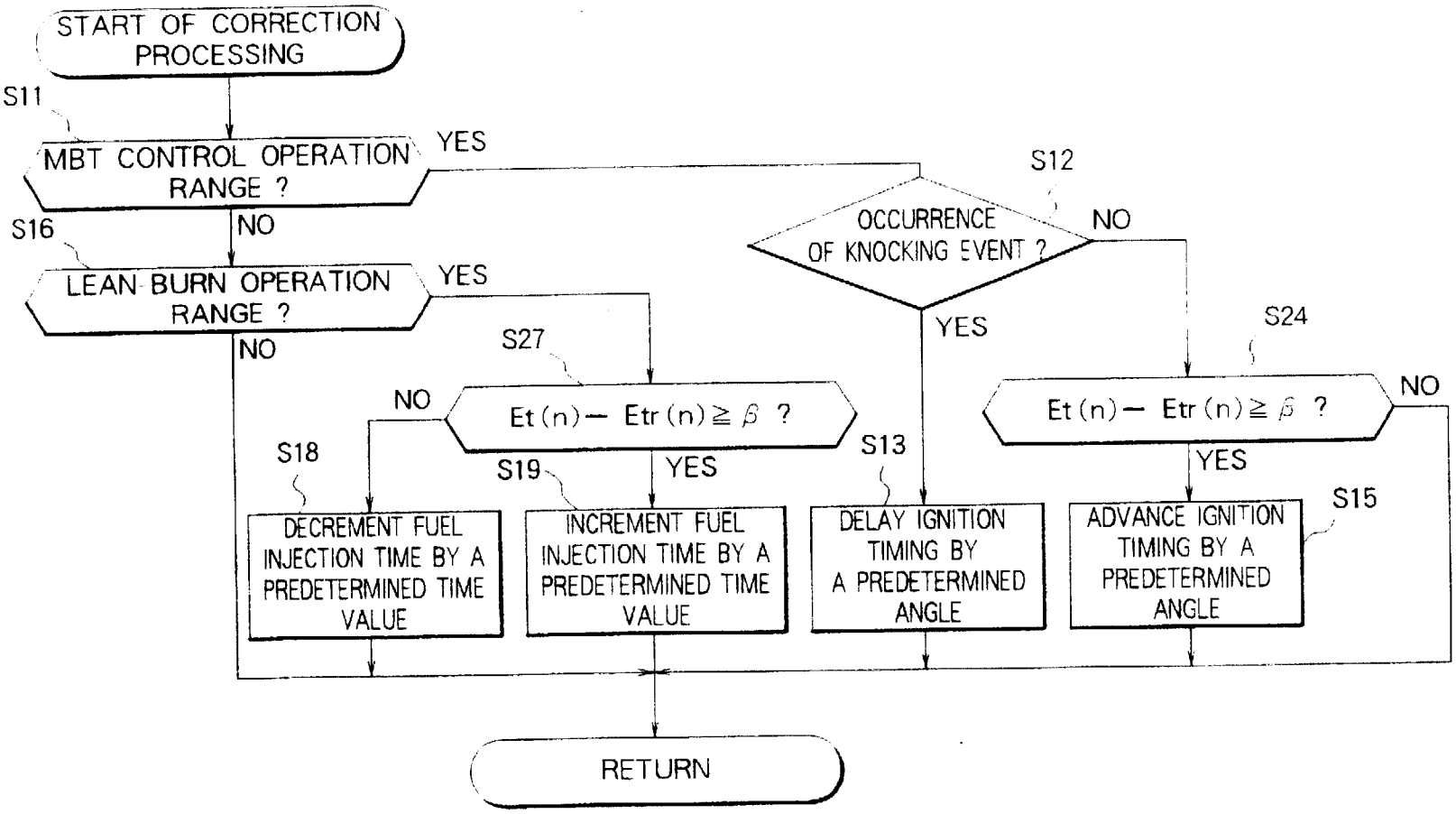
FIG. 12 is a flow chart for illustrating comparison/correction processing carried out by the engine control apparatus according to the third embodiment of the invention.

Now, referring to FIGS. 11 and 12 together with FIG. 9, description will be directed to the correction processing performed by the engine control apparatus according to the instant embodiment of the invention shown in FIGS. 8 and 10. Parenthetically, FIG. 11 is a characteristic diagram for illustrating graphically a relation between the peak occurrence time Tp of the ion current i and the engine output torque Te. As can be seen in this figure, as the peak occurrence time Tp becomes shorter within a crank angle range of A10° to A40° preceding to the top dead center (TDC), the engine output torque Te increases indicating thus with the combustion state in the engine is correspondingly enhanced.

FIG. 12 is a flow chart for illustrating operations of the comparator 27 and the control quantity arithmetic means 28, which flow chart is essentially same as that described hereinbefore by reference to FIG. 6 except that the expression defining the condition for the decision in the comparison steps S24 and S27 (corresponding to the steps S14 and S17) differ from the expression (2).

Furthermore, it should be mentioned that operation of the averaging means 26 is similar to the operation described hereinbefore by reference to the flow chart shown in FIG. 5 and thus can be defined by the expression (1) except for difference in respect to the variables involved in the arithmetic operation.

The waveform shaping circuit 14 cooperates with the current-to-voltage converter circuit 12 to shape the waveform of the ion current detection signal Ei for thereby generating the peak pulse signal Pi (see FIG. 9).

The peak occurrence time detecting means 29 incorporated in the electronic control unit 2 starts operation in response to the reset signal RS which is cleared at the time point the crank angle signal SGT falls, to thereby detect the peak occurrence time detection signal Et by converting the peak occurrence time Tp into a voltage signal till a time point at which the peak pulse signal Pi rises.

The peak occurrence time detection signal Et is then converted to a digital signal by the A/D converter 21 to be subsequently applied to a comparison input terminal of the comparator 27. Further, the peak occurrence time detection signal Et is converted to the reference peak occurrence time signal Etr by means of the averaging means 26, whereupon the reference peak occurrence time signal Etr is applied to a reference terminal of the comparator 27.

In that case, in the comparison decision step S24 or S27, the comparator 27 compares the peak occurrence time detection signal Et(n) detected currently and the reference peak occurrence time signal Etr(n) resulting from the averaging process described above, to thereby make decision whether or not difference between both input signals mentioned above is equal to or greater than the permissible value β, indicating that the combustion state is incomplete by checking whether or not the condition given by the following expression (3) is satisfied:

$$Et(n)-Etr(n)\geqq\beta \quad (3)$$

The comparison result indication signal F resulting from the decision processing mentioned above is then inputted to the control quantity arithmetic means 28. Unless the condition given by the expression (3) is satisfied, i.e., when Et(n)–Etr (n)<β (when the answer of the comparison decision step is negative "NO", to say in another way), this means that the peak occurrence time Tp advances sufficiently to ensure full availability of the engine output torque Te, as can be seen in FIG. 11.

Consequently, the control quantity arithmetic means 28 regards the peak occurrence time detection signal Et as indicating the normal combustion state. Thus, in the case of the maximum engine output or MBT control signal, no correction is made for the control parameters, while in the lean-burn operation range, the fuel injection quantity is decremented (step S18), whereupon the processing leaves the routine shown in FIG. 12.

On the other hand, when it is decided in the comparison/decision step S24 or S27 that the condition given by the above-mentioned expression (3) is satisfied (i.e., when the answer of the decision step S24 or S27 is affirmative "YES"), this means that the peak occurrence time Tp is accompanied with a delay and that the combustion state is deteriorated (the engine output torque Te is low). Accordingly, the correction for advancing the ignition timing (step S15) or correction for increasing the fuel injection quantity is executed (step S19).

Referring to the exemplary case illustrated in FIG. 9, the peak pulse signal Pi initially appearing in the peak occurrence time detection signal Et assumes a high level, indicating that the combustion state is poor. However, the second peak pulse signal Pi is of a low level owing to the correction of the control quantity (ignition timing or fuel injection quantity). In other words, it is indicated that the combustion state is improved.

In this manner, by comparing the peak occurrence time detection signal Et with the reference peak occurrence time signal Etr and inputting the comparison result indication signal F reflecting the combustion state to the control quantity arithmetic means 28, the control quantity of the control parameter (ignition timing or the fuel injection quantity) can be so optimized as to ensure a maximum engine output torque Te.

In the engine control apparatus according to the instant embodiment of the invention, the waveform shaping circuit 14 for obtaining the peak pulse signal Pi is incorporated in the ion current detecting means. It should however be understood that the waveform shaping circuit 14 may be incorporated in the electronic control unit 2, substantially to the same effect.

Furthermore, although the peak occurrence time detecting means 29 is implemented as an analogue circuit for converting the time Tp up to the rising edge of the peak pulse signal Pi into a corresponding voltage signal, it should be appreciated that the substantially same effect can be achieved by using a time count means (not shown) incorporated in the arithmetic unit 23. In that case, the digital value representing the time measured from the leading edge, for example, of the crank angle signal SGT or that of the ignition signal P up to the rising edge of the peak pulse signal Pi may be inputted to the averaging means 26 or the comparator 27. In that case, the A/D converter 21 can be spared, to another advantage.

Embodiment 4

In the case of the engine control apparatus according to the third embodiment of the present invention, the peak occurrence time Tp of the ion current detection signal Ei (the peak occurrence time detection signal Et) is used as the decision value in making decision as the combustion state in the engine cylinder. In this conjunction, it is further noted that a frequency at which extreme points (i.e., extreme values of positive polarity (plus sign) and/or extreme points of negative polarity (minus sign)) make appearance in the ion current detection signal Ei bears a relation to the combustion state of the engine. By taking into account this fact, the frequency at which the extreme points occur in of the ion current detection signal Ei (hereinafter referred to also as the extreme point occurrence frequency) can be used as the decision value in making decision as to the combustion state of the engine.

Figure 13:
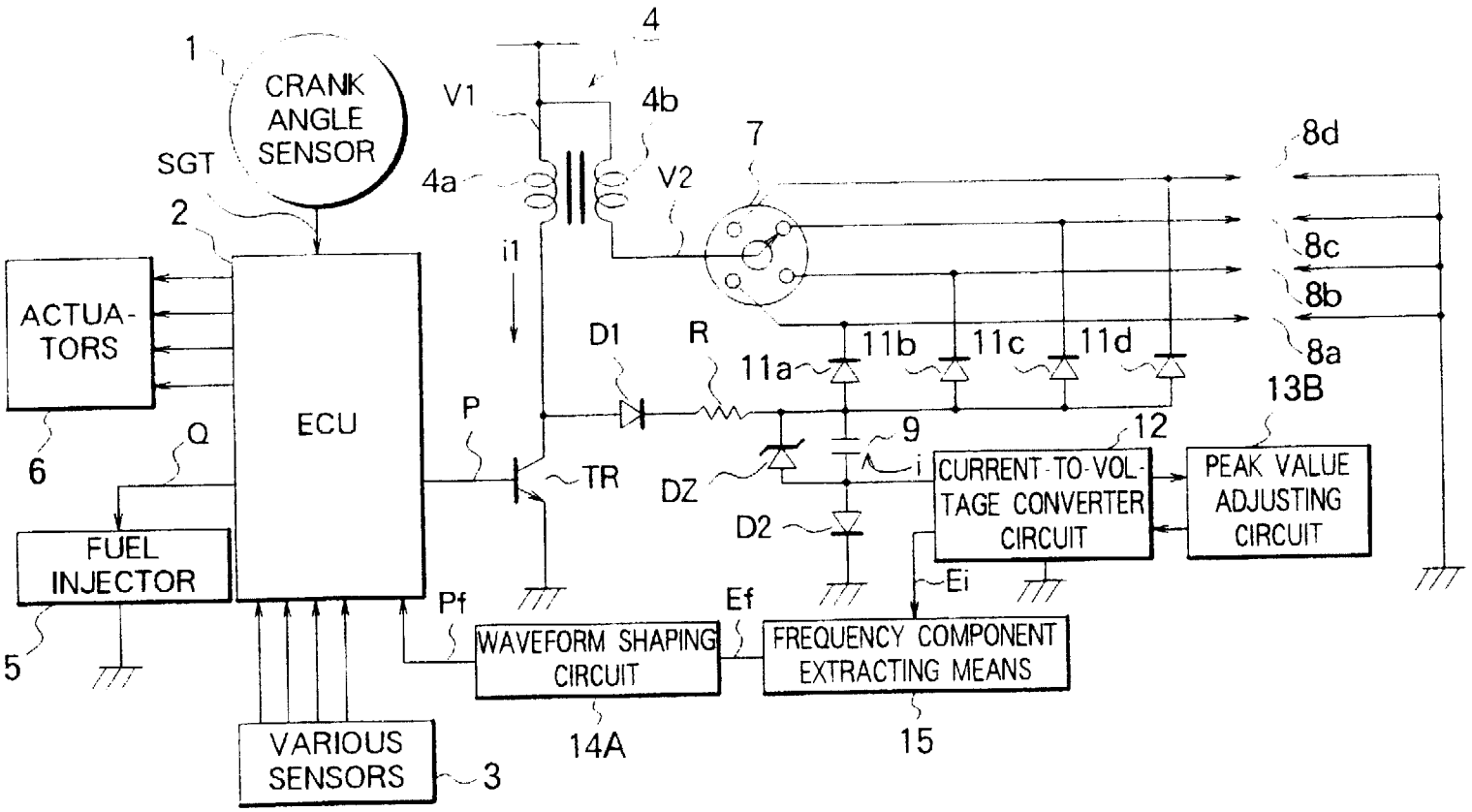
FIG. 13 is a block diagram showing schematically a basic structure of an engine control apparatus according to a fourth embodiment of the present invention.
Figure 14:
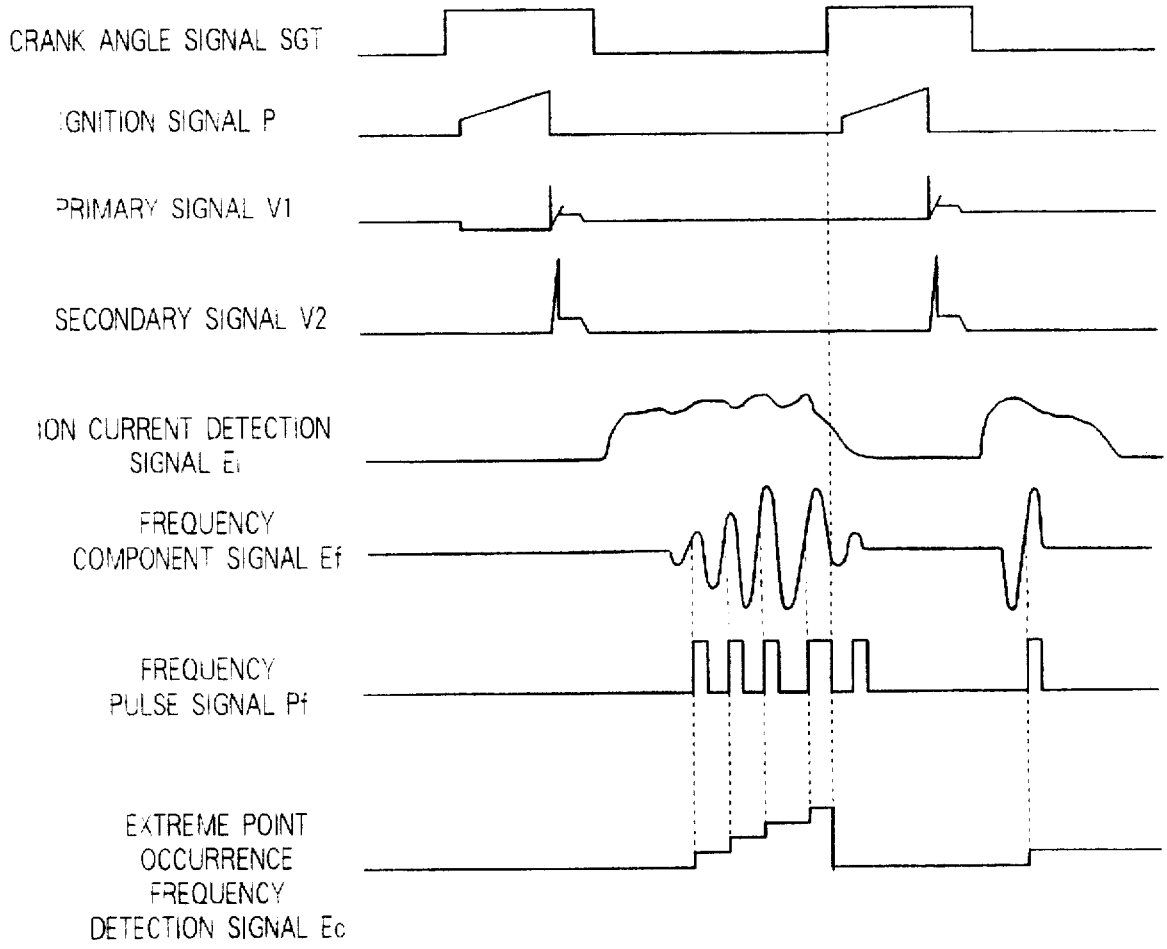
FIG. 14 is a timing chart for illustrating operations of the engine control apparatus shown in FIG. 13.
Figure 15:
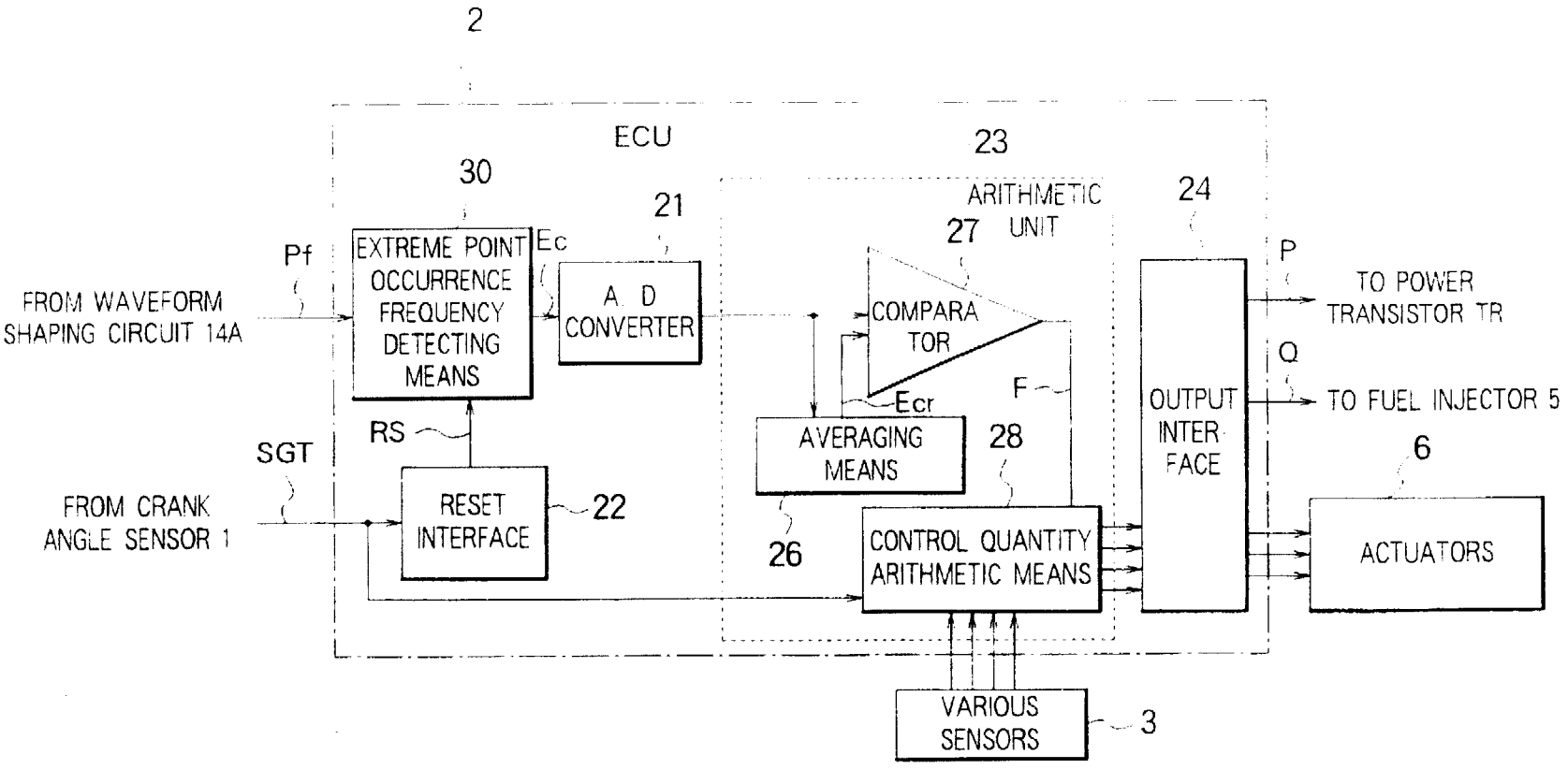
FIG. 15 is a functional block diagram showing a structure of an electronic control unit incorporated in the engine control apparatus according to the fourth embodiment of the invention.

FIG. 13 is a block diagram showing schematically and generally a basic structure of the engine control apparatus according to a fourth embodiment of the present invention in which the extreme point occurrence frequency of the ion current detection signal Ei is used as the decision value in making decision concerning the combustion state. Further, FIG. 14 is a timing chart showing waveforms of various signals generated in operation of the engine control apparatus shown in FIG. 13 on the assumption that combustion state is improved in a succeeding combustion cycle. Additionally, FIG. 15 is a functional block diagram showing an exemplary configuration of the electronic control unit (ECU) 2 incorporated in the engine control apparatus shown in FIG. 13. Parenthetically, in FIG. 13, components like as or equivalent to those described hereinbefore by reference to FIG. 8 are designated by like reference characters and repeated description in detail of these components is omitted.

In the case of the engine control apparatus now under consideration, the peak value adjusting circuit 13B is so designed that the conversion rate of the current-to-voltage converter circuit 12 can be adjusted continuously or in a stepless manner and that the frequency components corresponding to the extreme point waveforms, respectively, of the ion current detection signal Ei are not cut off.

A frequency component extracting means 15 inserted at the output side of the current-to-voltage converter circuit 12 is adapted to extract and amplify only those frequency components which correspond to the extreme points of the ion current detection signal Ei to thereby output a frequency component signal Ef (see FIG. 14).

On the other hand, the waveform shaping means 14A is so designed as to compare the frequency component signal Ef with a predetermined voltage level (e.g. a voltage level slightly higher than a noise level), to thereby output a frequency pulse signal Pf indicating a frequency (or a number) of the extreme points (extreme point of positive polarity in the illustrated case). The waveform shaping means 14A and the frequency component extracting means 15 cooperate with the current-to-voltage converter circuit 12 and implemented as parts of the ion current detecting means.

At this juncture, it should be mentioned that although only the extreme points of positive polarity are extracted to thereby generate the frequency pulse signal Pf, the extreme points of negative (minus) polarity may be converted into pulses or alternatively both the extreme points of positive and negative (plus and minus) polarities may be converted into pulses containing in the frequency pulse signal Pf. Apparently, when the extreme points of positive and negative polarities are to be converted into the pulses, the waveform shaping means 14A is so designed as to compare the frequency component signal Ef with two predetermined voltage levels of positive and negative polarities, respectively, for the waveform shaping.

Next, description will turn to the electronic control unit by reference to FIG. 15 in which those components described hereinbefore in conjunction with FIG. 10 are denoted by like reference characters and repeated description thereof will be omitted.

The extreme point occurrence frequency detecting means 30 incorporated in the electronic control unit 2 generates as an extreme point occurrence frequency detection signal Ec a voltage corresponding to the extreme point occurrence frequency on the basis of the frequency pulse signal Pf outputted from the waveform shaping means 14A (see FIG. 14).

In that case, the extreme point occurrence frequency detecting means 30 is reset by the reset signal RS when the crank angle signal SGT is at the "H" level. Accordingly, the extreme point occurrence frequency detecting means 30 is so designed or programmed that the extreme point occurrence frequency is converted into a voltage signal by counting the extreme point occurrence events during a period in which the crank angle signal SGT is at the "L" level, to thereby output the extreme point occurrence frequency detection signal Ec (see FIG. 14).

On the other hand, the averaging means 26 averages a digital signal resulting from the A/D conversion of the extreme point occurrence frequency detection signal Ec by the A/D converter 21 to thereby generate a reference extreme point occurrence frequency signal Ecr. The comparator 27 compares the digital signal obtained by A/D conversion of the extreme point frequency detection signal Ec with the reference extreme point occurrence frequency signal Ecr to thereby output a comparison result indication signal F to the control quantity arithmetic means 28. Thus, the control quantity arithmetic means 28 can correct the control quantity on the basis of the comparison result indication signal F which reflects the combustion state of the engine, as described hereinbefore.

Figure 16:
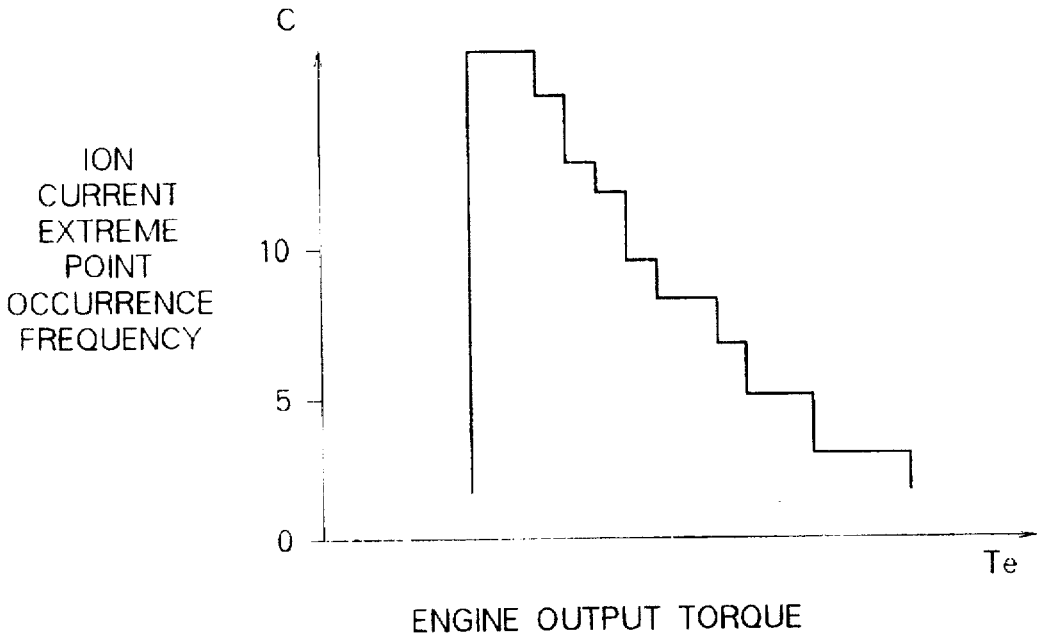
FIG. 16 is a characteristic diagram for illustrating graphically a relation between an extreme point occurrence frequency of an ion current and an engine output torque.
Figure 17:
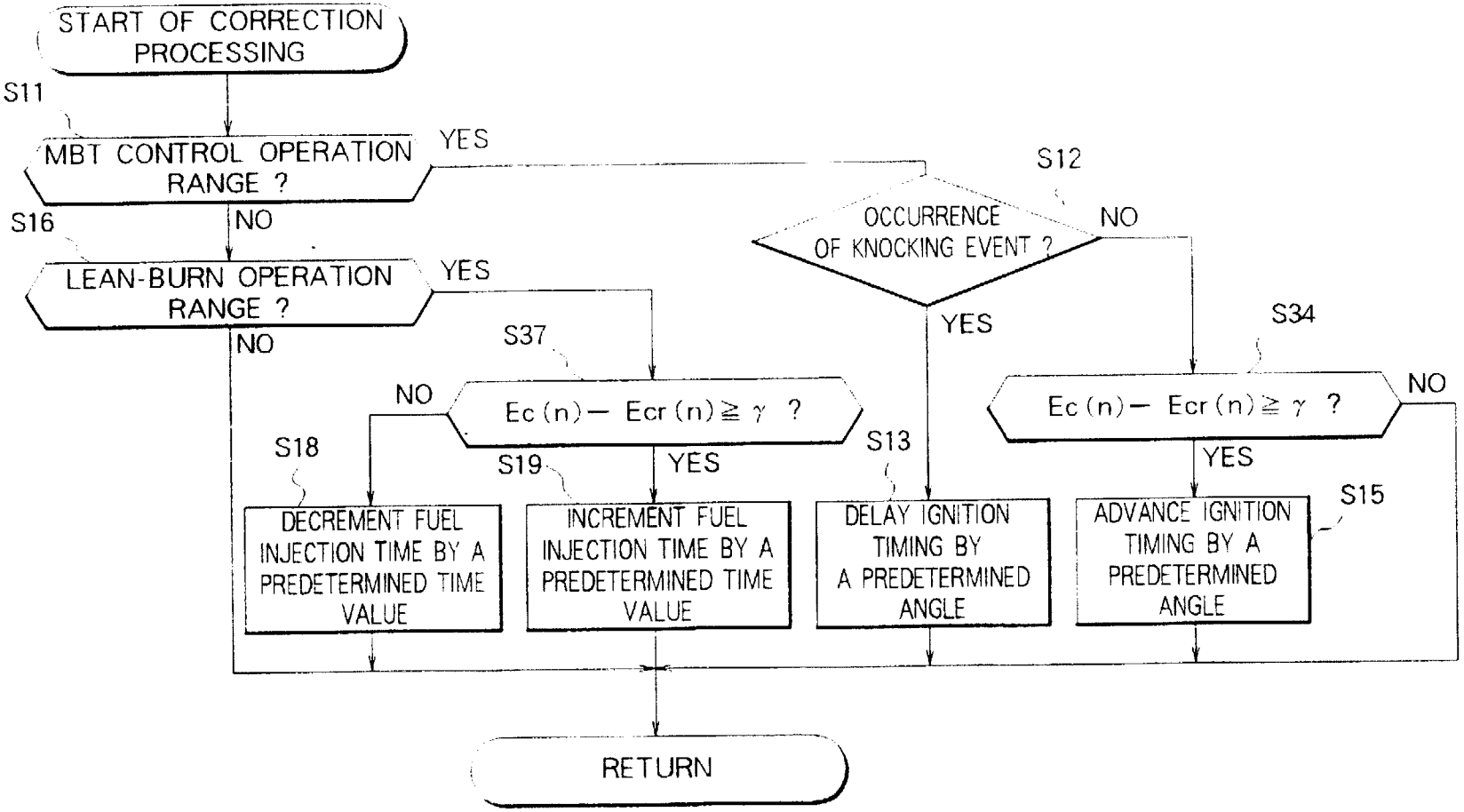
FIG. 17 is a flow chart for illustrating comparison/correction processing performed by the engine control apparatus according to the fourth embodiment of the invention.

Now, referring to FIGS. 16 and 17 together with FIG. 14, description will be directed to the correction processing performed by the engine control apparatus according to the fourth embodiment of the invention shown in FIGS. 13 and 15. Parenthetically, FIG. 16 is a characteristic diagram for illustrating graphically a relation between the extreme point occurrence frequency C of the ion current i and the engine output torque Te. It can readily be understood from this figure that as the extreme point occurrence frequency C indicating by the signal Ec decreases within a range in which the extreme point occurrence frequency C is less than 20 per cycle, the engine output torque Te increases with the combustion state thereof being correspondingly enhanced.

FIG. 17 is a flow chart for illustrating operations of the comparator 27 and the control quantity arithmetic means 28, which flow chart is approximately same as that described hereinbefore by reference to FIG. 12 except that the formulae for the decision performed in comparison steps S34 and S37 (corresponding to the steps S24 and S27 mentioned previously) differ from the expression (3).

Furthermore, it should be mentioned that operation of the averaging means 26 is similar to the operation described hereinbefore by reference to the flow chart shown in FIG. 5 and thus can be given by the expression (1) except for difference in respect to the variables involved in the arithmetic operation.

Referring to the figure, the frequency component extracting means 15 cooperates with the current-to-voltage converter circuit 12 to output the frequency component signal Ef indicating the extreme points appearing in the ion current detection signal Ei, while the waveform shaping means 14A outputs the frequency pulse signal Pf.

The extreme point occurrence frequency detecting means 30 incorporated in the electronic control unit 2 responds to the reset signal RS which is cleared at the falling edge of the crank angle signal SGT, to thereby output the extreme point occurrence frequency detection signal Ec by converting the frequency of the pulses or extreme points contained in the frequency pulse signal Pf into a corresponding voltage level signal, as can be seen in FIG. 14.

The extreme point occurrence frequency detection signal Ec then undergoes analogue-to-digital conversion by the A/D converter 21 to be subsequently compared with the reference extreme point occurrence frequency signal Ecr by the comparator 27.

In the comparison decision steps S34 or S37, the comparator 27 compares the extreme point occurrence frequency signal Ec(n) detected currently and the reference extreme point occurrence frequency signal Ecr(n) determined by the averaging operation mentioned hereinbefore, to thereby make decision whether or not difference between both input signals is greater than a permissible value γ inclusive thereof, which value indicates that the combustion state is incomplete, by checking whether or not the condition given by the following expression (4) is satisfied:

$$Ec(n)-Ecr(n)\geqq\gamma \quad (4)$$

The comparison result indication signal F resulting from the decision mentioned above is then inputted to the control quantity arithmetic means 28. Unless the condition given by the expression (4) is satisfied, i.e., when $Ec(n)-Ecr(n)<\gamma$ (the answer of the comparison decision step S34 is negative "NO"), this means that the extreme point occurrence frequency C is sufficiently low to ensure full availability of the engine output torque Te. Consequently, the control quantity arithmetic means 28 regards the extreme point occurrence frequency detection signal Ec as indicating the normal combustion state. Thus, no correction is performed for the control parameters so long as the engine operates in the MBT control range. On the other hand, when the engine operates in the lean-burn operation mode or range, the fuel injection quantity is decremented (step S18), whereupon the processing leaves the routine shown in FIG. 17.

On the other hand, when it is decided in the comparison/decision step S34 or S37 that the condition given by the above-mentioned expression (4) is satisfied (i.e., when the answer of the decision step S34 or S37 is affirmative "YES"), this means that the extreme point occurrence frequency C increases, indicating that the combustion state is deteriorated (the engine output torque Te is lowered). Accordingly, the correction for advancing the ignition timing is performed in the step S15 or alternatively correction for increasing the fuel injection quantity is executed in the step S19.

Referring to the illustrative case shown in FIG. 14, the extreme point occurrence frequency detection signal Ec indicating the extreme point occurrence frequency C of the frequency pulse signal Pf assumes a high level in the first change of the ion current detection signal Ei, indicating that the combustion state is poor. However, in the second change of the ion current detection signal Ei, the extreme point occurrence frequency detection signal Ec is of a low level owing to the correction of the control quantity (ignition timing or fuel injection quantity) or parameter. In other words, it is indicated that the combustion state is improved.

In this manner, by comparing the extreme point occurrence frequency detection signal Ec with the reference extreme point occurrence frequency signal Ecr and inputting the comparison result indication signal F reflecting the combustion state of the engine to the control quantity arithmetic means 28, the control quantity or the control parameter (ignition timing or the fuel injection quantity) can be optimized, whereby a maximum engine output torque Te is made available.

In the engine control apparatus according to the fourth embodiment of the invention, it has been described that the waveform shaping means 14A for deriving the frequency pulse signal Pf is incorporated in the ion current detecting means, it should be understood that the waveform shaping means 14A may be incorporated in the electronic control unit 2, substantially to the same effect.

Embodiment 5

In this case of the engine control apparatus according to the fourth embodiment of the invention described, the extreme point occurrence frequency detecting means 30 which is designed to convert the pulse frequency signal Pf into a voltage signal is employed for determining the extreme point occurrence frequency C. However, the extreme point occurrence frequency C may be determined by counting straightforwardly the number of the pulses or the frequency of the extreme points contained in the frequency pulse signal Pf without resorting to the extreme point occurrence frequency detecting means 30.

Figure 18:
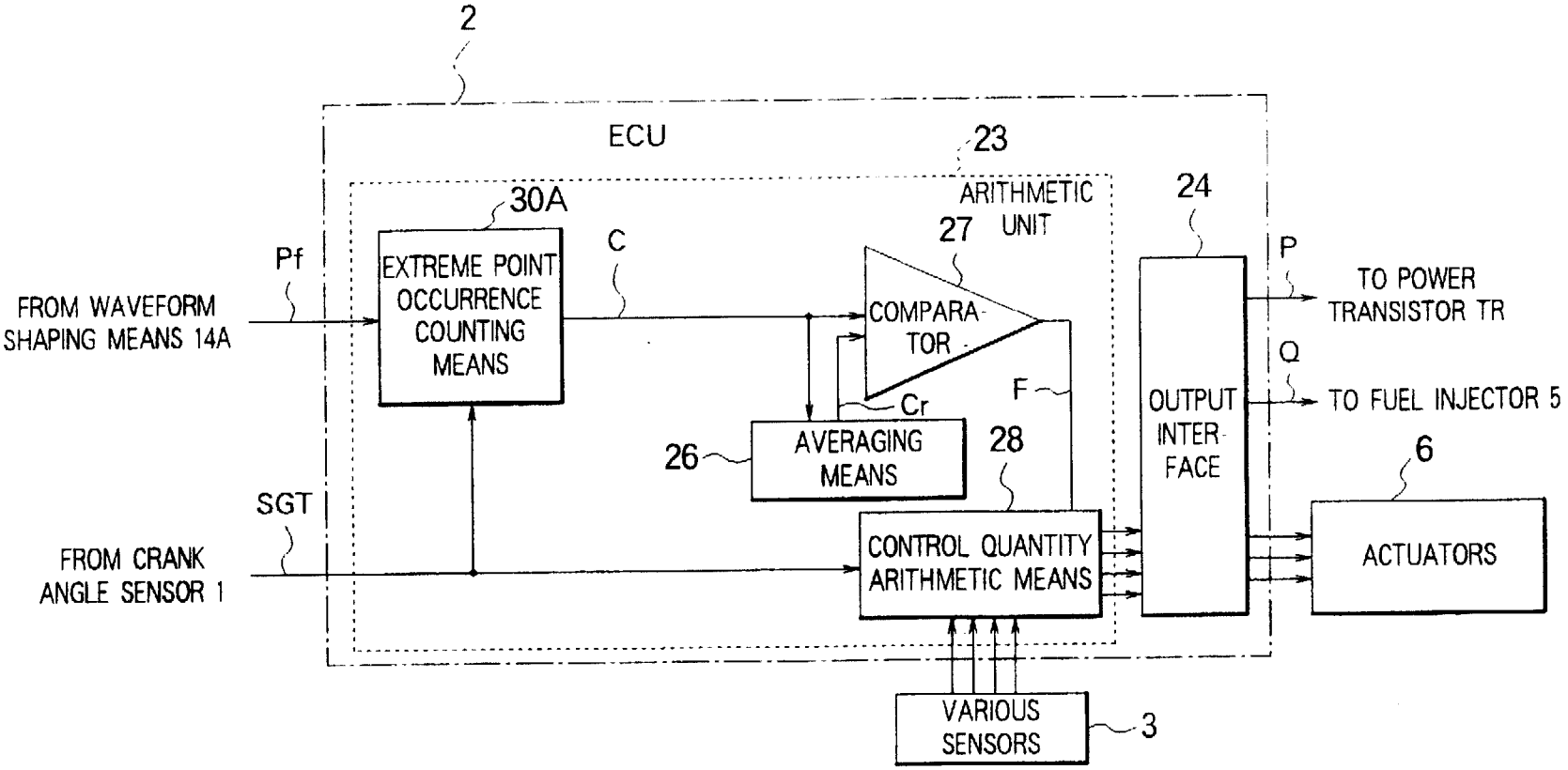
FIG. 18 is a functional diagram showing a structure of an electronic control unit according to a fifth embodiment of the invention.

FIG. 18 is a functional diagram showing a structure of the electronic control unit 2 according to a fifth embodiment of the invention in which an extreme point occurrence counting means is employed. Except that the A/D converter 21 and the reset interface 22 (shown in FIG. 15) are spared, the electronic control unit 2 is similar to that described previously. Further, it should be mentioned that the extreme point occurrence frequency counting means denoted by 30A is functionally equivalent to the extreme point occurrence frequency detecting means 30.

In the case of the engine control apparatus according to the instant embodiment of the invention, an extreme point occurrence counting means 30A designed for outputting the extreme point occurrence frequency C as the digital signal is incorporated in the arithmetic unit 23 in place of the extreme point occurrence frequency detecting means 30 mentioned previously (refer to FIG. 15). Besides, the A/D converter 21 is rendered unnecessary. Additionally, because the extreme point occurrence counting means 30A is reset directly by the crank angle signal SGT, the reset interface 22 can be spared.

Further, since the extreme point occurrence counting means 30A is reset softwarewise internally of the arithmetic unit 23 when the crank angle signal SGT is at the "H" level, the frequency C of the extreme points making appearance in the frequency pulse signal Pf are counted to be held only when the crank angle signal SGT is at the "L" level. It should further be mentioned that the extreme point occurrence counting means 30A is so designed as to determine the extreme point occurrence frequency C by counting the rising edges or the falling edges of the pulses contained in the frequency pulse signal Pf, to thereby count the extreme points.

In this manner, by comparing the peak occurrence time detection signal Et with the reference peak occurrence time signal Etr and inputting the comparison result indication signal F reflecting the combustion state of the engine to the control quantity arithmetic means 28, the control quantity or the control parameter (ignition timing or the fuel injection quantity) can be optimized to ensure a maximum engine output torque Te.

Embodiment 6

In the engine control apparatus according to the fourth embodiment of the present invention, the extreme point occurrence frequency C of the ion current detection signal Ei is used as the decision value in making decision as to the combustion state of the engine. In this conjunction, it is further noted that the detection start time point of the ion current i also reflects the combustion state of the engine. Thus, by taking this fact into account, the detection start time point of the ion current i (i.e., the rise-up time point of the ion current detection signal Ei) can be used as the decision value.

Figure 19:
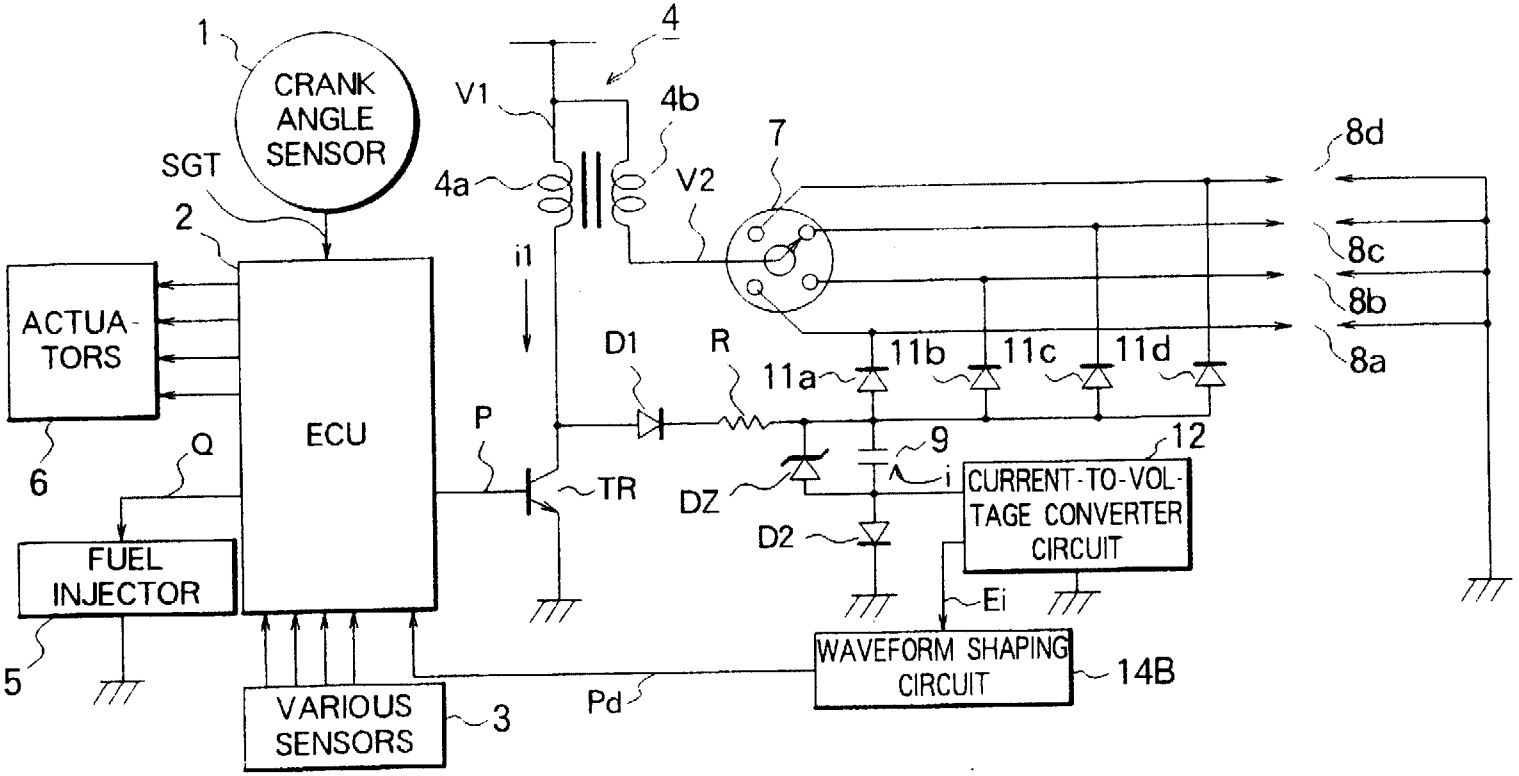
FIG. 19 is a block diagram showing generally a basic structure of an engine control apparatus according to a sixth embodiment of the present invention.

FIG. 19 is a block diagram showing schematically and generally a basic structure of the engine control apparatus according to a sixth embodiment of the present invention in which the detection start time point (i.e., rise-up time point) of the ion current i is used as the decision value in making decision concerning the combustion state of the engine. By reference to FIG. 19, those components described hereinbefore in conjunction with FIG. 13 are denoted by like reference characters and repetitive description thereof will be omitted.

Figure 20:
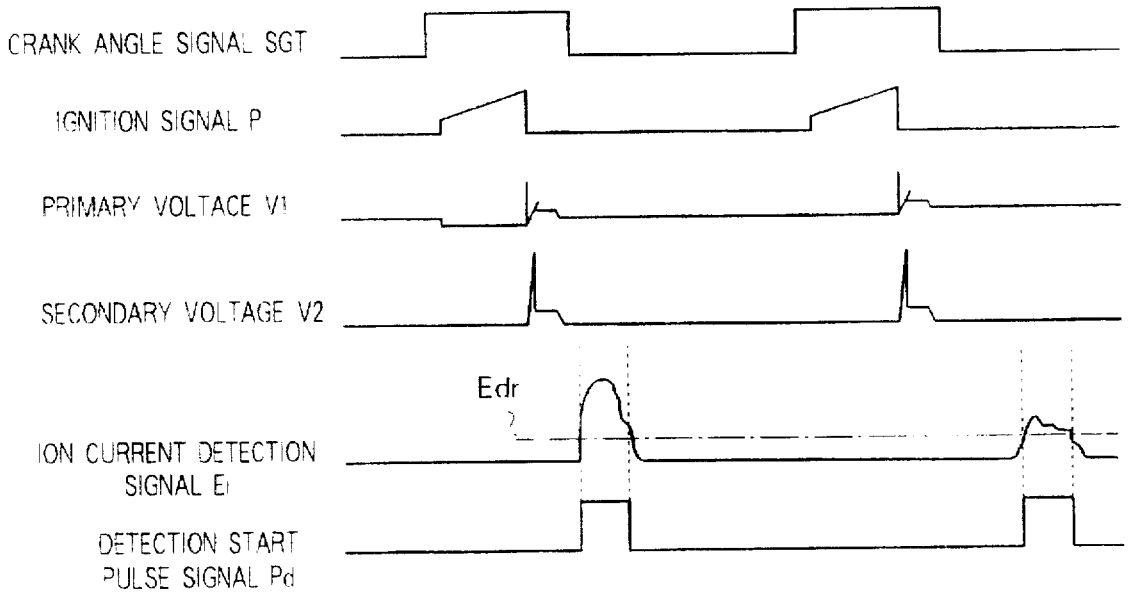
FIG. 20 is a timing chart for illustrating operations of the engine control apparatus according to the sixth embodiment of the invention.

Further, FIG. 20 is a timing chart for illustrating waveforms of various signals generated in operation of the engine control apparatus shown in FIG. 19 on the assumption that the ion current detection signal Ei indicates unsatisfactory combustion state in a second combustion cycle of the engine.

In this case, the waveform shaping means 14B is so designed as to compare the ion current detection signal Ei with a predetermined voltage level (a voltage level slightly higher than a noise level), to thereby output a detection start pulse signal Pd.

At this juncture, it should also be added that a peak value adjusting circuit 13B may be provided in association with the current-to-voltage converter circuit 12, as described hereinbefore by reference to FIG. 13, although illustration thereof is omitted in FIG. 19.

Figure 21:
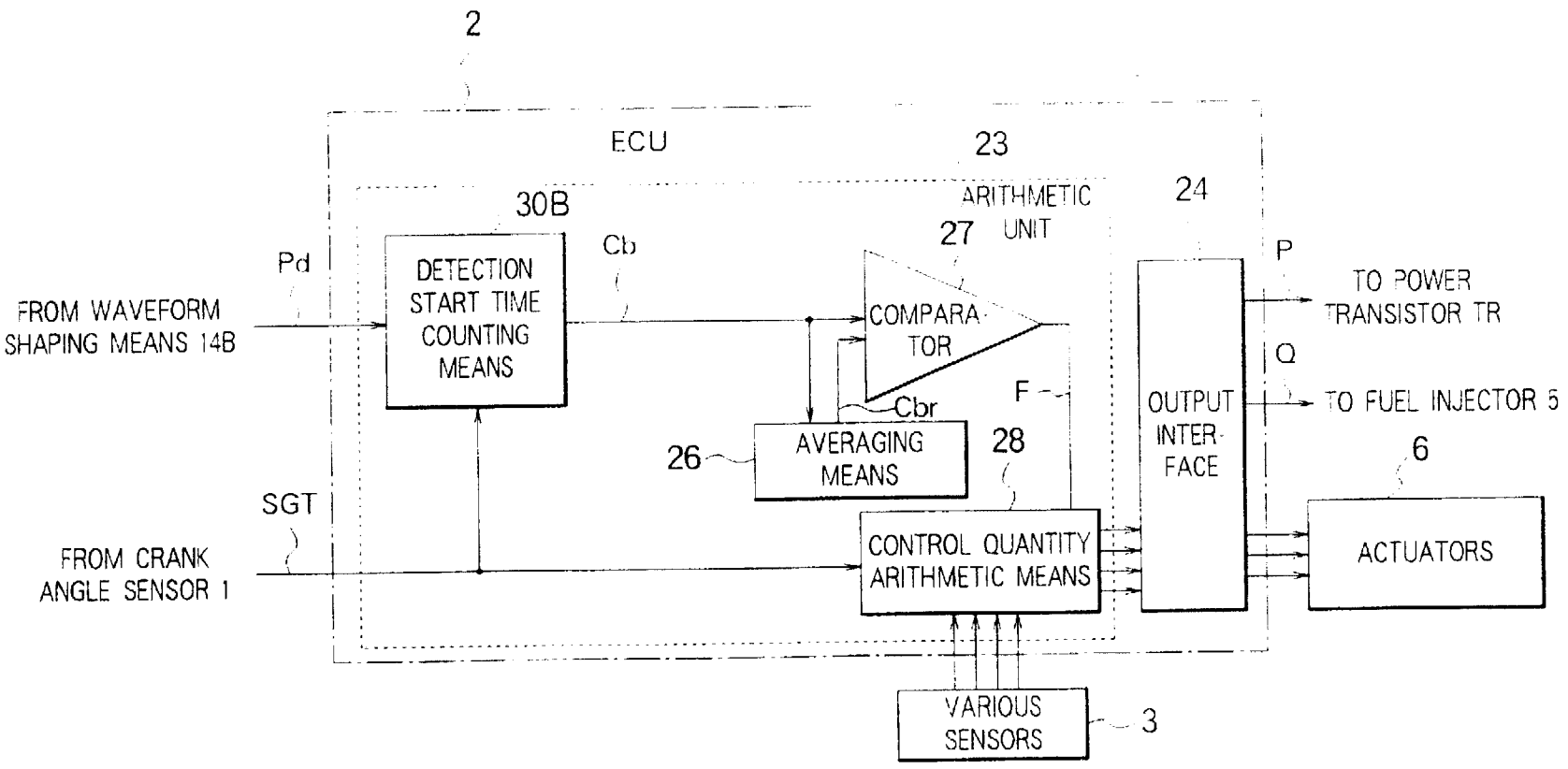
FIG. 21 is a functional block diagram showing a structure of an electronic control unit incorporated in the engine control apparatus according to the sixth embodiment of the invention.

Further, FIG. 21 is a functional block diagram showing an exemplary configuration of the electronic control unit (ECU) 2 incorporated in the engine control apparatus shown in FIG. 19. In the figure, components like as or equivalent to those described hereinbefore by reference to FIG. 18 are designated by like reference characters and repeated description in detail of these components is omitted.

In the case of the instant embodiment of the invention, the detection start time counting means 30B incorporated in the arithmetic unit 23 determines the detection start time Cb intervening between a time point corresponding to the rising edge of the detection start pulse signal Pd and the pulse edge of the crank angle signal SGT serving as the reference. Parenthetically, the detection start time counting means 30B is adapted to be reset softwarewise internally the arithmetic unit 23.

On the other hand, the averaging means 26 is so designed as to output the reference detection start time point Cbr which is determined by averaging the detection start times Cb over a predetermined number of cycles or period, while the comparator 27 compares the detection start time point Cb with the reference detection start time point Cbr to thereby output the comparison result indication signal F. The control quantity arithmetic means 28 in turn optimizes the control quantity or the control parameters (e.g. ignition timing or the fuel injection quantity) on the basis of the comparison result indication signal F in such a similar manner as described previously. In this way, a maximum engine output torque Te can be ensured.

Figure 22:
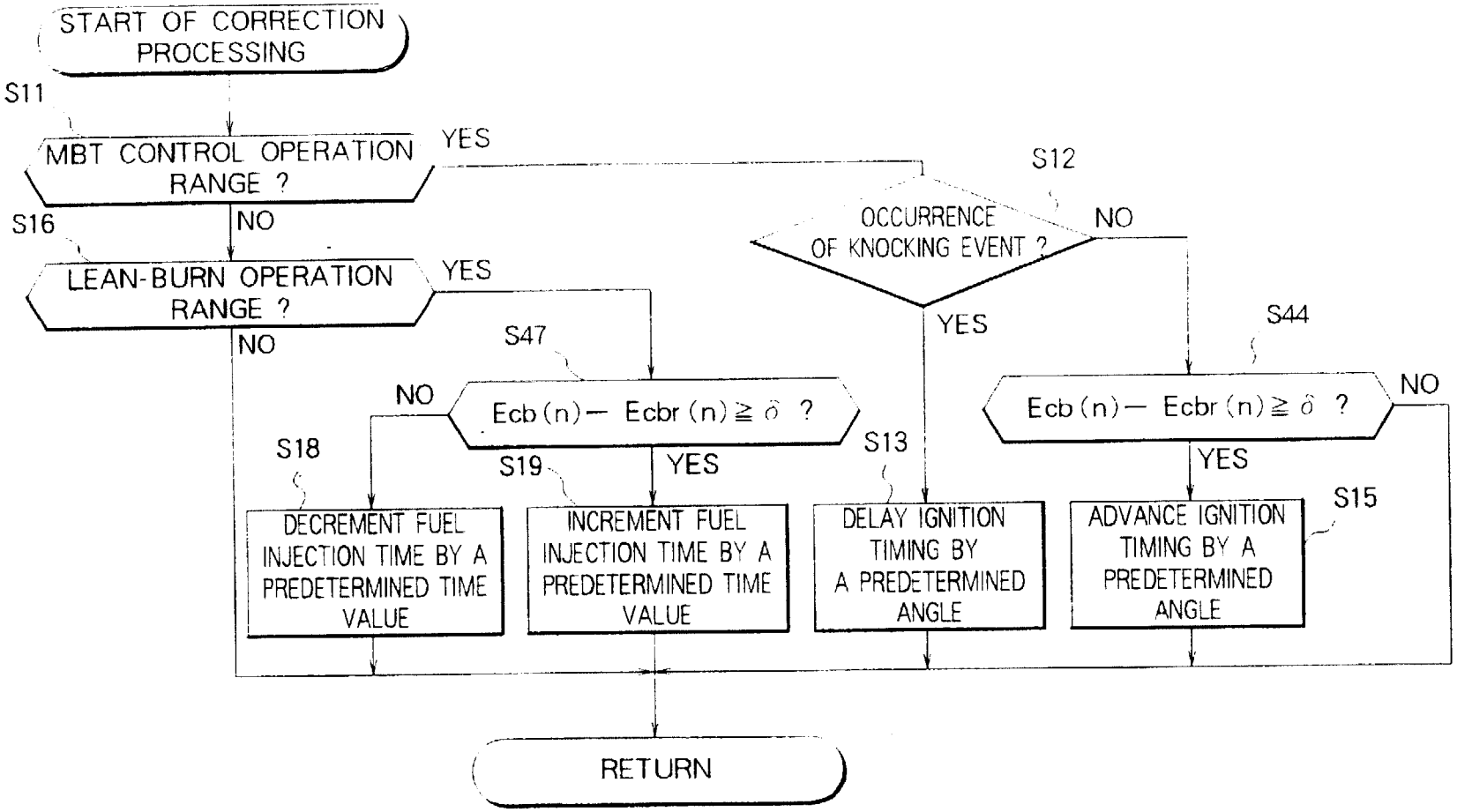
FIG. 22 is a flow chart for illustrating a comparison/correction processing executed by the engine control apparatus according to the sixth embodiment of the invention.

Now, referring to a flow chart shown in FIG. 22 together with the timing chart shown in FIG. 20, description will turn to the correction processing performed by the engine control apparatus according to the sixth embodiment of the invention shown in FIGS. 19 and 21.

Referring to FIG. 21, the detection start time Cb indicated by the signal outputted from the detection start time counting means 30B becomes shorter as the engine output torque Te is higher, indicating a satisfactory combustion state, while the detection start time Cb becomes longer as the engine output torque Te is lower, indicating that the combustion state being unsatisfactory.

FIG. 22 is a flow chart for illustrating operations of the comparator 27 and the control quantity arithmetic means 28, which flow chart is substantially same as that described hereinbefore by reference to FIG. 17 except that the expression providing the basis for the decision made in comparison steps S44 and S47 (corresponding to the steps S34 and S37) differ from the expression (4).

Operation of the averaging means 26 is performed in a same manner as described previously in conjunction with the flow chart of FIG. 5 and the expression (1).

At first, the waveform shaping means 14B compares the ion current detection signal Ei supplied from the current-to-voltage converter circuit 12 with the predetermined reference voltage Edr to thereby convert the ion current detection signal Ei to a pulse signal which is then outputted from the waveform shaping means 14B as the detection start pulse signal Pd (see FIG. 20).

On the other hand, the detection start time counting means 30B incorporated in the electronic control unit 2 operates in response to the edge of the crank angle signal SGT to measure a time up to the rising edge of the pulse contained in the detection start pulse signal Pd. Thus, the signal indicating the detection start time Cb is outputted from the detection start time counting means 30B.

Subsequently, in the comparison decision steps S44 or S47, the comparator 27 compares the detection start time Cb(n) of the ion current i detected currently and the reference detection start time Cbr(n), to thereby determine whether or not difference between both input signals mentioned above is greater than a permissible value δ, indicating that the combustion state is incomplete, by deciding whether or not the condition given by the following expression (5) is satisfied:

$$Cb(n)-Cbr(n)\geqq\delta \quad (5)$$

The comparison result indication signal F resulting from the comparison/decision processing mentioned above is then inputted to the control quantity arithmetic means 28. Unless the condition given by the expression (5) is met, i.e., when $Cb(n)-Cbr(n)<\delta$ (when the answer of the comparison decision step is negative "NO"), this means that the detection start time Cb(n) for the ion current i is short, and hence indicates good combustion state to ensure good availability of the engine output torque Te.

Consequently, the control quantity arithmetic means 28 regards the detection start time Cb as indicating the normal combustion state. Thus, when the engine operates in the MBT control mode, no correction is performed for the control parameters. On the other hand, in the lean-burn operation range, the fuel injection quantity is decremented (step S18), whereupon the processing leaves the routine shown in FIG. 22.

On the other hand, when it is decided in the comparison/decision step S44 or S47 that the condition given by the above-mentioned expression (5) is satisfied (i.e., when the answer of the decision step S44 or S47 is affirmative "YES"), this means that the rise-up time of the ion current detection signal Ei is delayed, indicating that the combustion state is degraded or deteriorated (with the engine output torque Te being low). Accordingly, the correction for advancing the ignition timing (step S15) or correction for increasing the fuel injection quantity is executed in a step S19.

In this way, by comparing the detection start time Cb for the ion current i with the reference detection start time Cbr and outputting the comparison result indication signal F reflecting the combustion state of the engine to the control quantity arithmetic means 28, the control quantity of the control parameter (ignition timing or the fuel injection quantity) can be optimized to ensure a maximum engine output torque Te.

In the foregoing, although it has been described that the waveform shaping means 14B for obtaining the detection start pulse signal Pd is incorporated in the ion current detecting means, it should be understood that the waveform shaping means 14B may be incorporated in the electronic control unit 2, substantially to the same effect.

Furthermore, although it has been described that the pulse edge of the crank angle signal SGT is employed as the reference time point for measuring the time till the rising edge of the detection start pulse Pd (or the rising of the ion current detection signal Ei), it should be appreciated that the ignition timing based on the ignition signal P may be used, substantially to the same effect.

Besides, although the detection start time Cb for the ion current i is determined through the digital arithmetic processing by the detection start time counting means 30B incorporated in the arithmetic unit 23, such arrangement may equally be adopted that a detection or conversion circuit (not shown) is provided for converting the time (the detection start time Cb) intervening between the reference time point and the detection start pulse Pd, into an analogue signal, wherein the output of the detection or conversion circuit may be inputted to the arithmetic unit 23 by way of an A/D converter (not shown either).

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described.

By way of example, it is contemplated that storage or recording media on which the teachings of the invention are recorded in the form of programs executable by computers inclusive of microprocessor are to be covered by the invention. Of course, a microcomputer or microprocessor programmed to carry out the invention is equally covered by the invention.

Accordingly, all suitable modifications and equivalents may be resorted to, falling within the spirit and scope of the invention.

What is claimed is:

1. A control apparatus for an internal combustion engine, comprising:

ion current detecting means for detecting an amount of ions generated within an engine cylinder under control in terms of an ion current immediately after ignition in said engine cylinder;

decision value detecting means responsive to said ion current detecting means for determining a decision value reflecting a combustion state of said engine cylinder on the basis of a detected value of said ion current a comparator for comparing said decision value to a reference value; and correction control means responsive to said comparator for correcting a control parameter of said internal combustion engine when result of comparison of said decision value with the reference value indicates low output power of said internal combustion engine or degradation in the combustion efficiency.

2. An engine control apparatus according to claim 1, wherein said decision value corresponds to a peak value of said ion current detection value.

3. An engine control apparatus according to claim 2, wherein said ion current detecting means includes a gain change-over circuit for selectively changing a gain signal in dependence on the level of said ion current detection value, and wherein said decision value detecting means calculates the decision value on the basis of said ion current detection value and the gain signal supplied from said gain change-over circuit.

4. An engine control apparatus according to claim 2, wherein said control parameter sets an ignition timing for said engine cylinder;

and wherein said correction control means further comprises an averaging means for calculating said reference value based on averaging said ion current.

5. An engine control apparatus according to claim 2, wherein said control parameter sets a fuel injection quantity which determines an air-fuel ratio, and wherein said correction control means changes said fuel injection quantity when the result of the comparison between said peak value and said reference value indicates degradation in efficiency of said combustion.

6. An engine control apparatus according to claim 1, wherein said decision value is determined on the basis of timing of a peak in said ion current detection value.

7. An engine control apparatus according to claim 6, wherein said control parameter controls the ignition timing for said engine cylinder, and wherein said correction control means changes said ignition timing when the result of the comparison between the timing of said peak and said reference value indicates lowering in output power of said internal combustion engine.

8. An engine control apparatus according to claim 6, wherein said control parameter sets a fuel injection quantity which determines an air-fuel ratio, and wherein said correction control means changes said fuel injection quantity when the result of the comparison between the timing of said peak and said reference values indicates degradation of said combustion state.

9. An engine control apparatus according to claim 1, wherein said decision value is determined on the basis of a frequency of extreme points occurring in said ion current detection value.

10. An engine control apparatus according to claim 9, wherein said decision value detecting means includes:

frequency component extracting means for extracting frequency components equivalent to extreme-points component from said ion current detection value;

waveform shaping means for shaping said frequency components outputted from said frequency component extracting means into a pulse signal containing pulses corresponding to said frequency components;

wherein said extreme point occurrence frequency is determined on the basis of said pulse signal.

11. An engine control apparatus according to claim 9, wherein said control parameter controls ignition timing, and wherein said correction control means corrects said ignition timing when the result of the comparison between said extreme point occurrence frequency and reference extreme point occurrence frequency indicates lowering of output power of said internal combustion engine.

12. An engine control apparatus according to claim 9, wherein said control parameter sets a fuel injection quantity which determines an air-fuel ratio, and wherein said correction control means corrects said fuel injection quantity when the result of the comparison between said extreme point occurrence frequency and a reference extreme point occurrence frequency indicates degradation of said combustion state.

13. An engine control apparatus according to claim 1, wherein said decision value is determined according to a detection start time at which detection of said ion current is started.

14. An engine control apparatus according to claim 13, wherein said control parameter sets ignition timing, and wherein said correction control means changes said ignistion timing when the result of the comparison between said detection start time of said ion current and a reference detection start time indicates lowering of output power of said internal combustion engine.

15. An engine control apparatus according to claim 13, wherein said control parameter sets a fuel injection quantity which determines an air-fuel ratio, and wherein said correction control means corrects said fuel injection quantity when the result of the comparison between said detection start time of said ion current and a reference detection start time indicates degradation of said combustion state.

16. An engine control apparatus according to claim 1, further comprising means for determining occurrence of knocking in said internal combustion engine;

wherein said correction control means including means for deciding whether or not said internal combustion engine operates in a minimum-spark-advance-for-best-torque control operation range, wherein said correction control means advances the ignition-timing stepwise by a predetermined angle within a range in which the knocking can not take place, when the result of said comparison indicates lowering in the output power of said internal combustion engine beyond a permissible value in said minimum-spark-advance-for-best-torque control operation range.

17. An engine control apparatus according to claim 1, said correction control means including means for deciding whether or not said internal combustion engine operates in a fuel-lean operation range, wherein said correction control means decrements the fuel injection by a predetermined amount, when the result of said comparison indicates a satisfactory combustion state in said fuel-lean operation range of said internal combustion engine, and wherein said correction-control means increments said fuel injection quantity for said cylinder under control, when the result of said comparison indicates degradation beyond a predetermined value within said fuel-lean operation range of said internal combustion engine.

18. In an internal combustion engine including at least one engine cylinder, fuel injecting means for charging an air-fuel mixture into said engine cylinder and ignition means for triggering combustion of said air-fuel mixture within said engine cylinder, a method of controlling operation of said internal combustion engine, comprising the steps of:

detecting an ion current generated within said engine cylinder upon combustion of said air-fuel mixture;

determining a decision value reflecting efficiency of said combustion on the basis of said detected ion current;

averaging a plurality of said decision values determined throughout a predetermined preceding time period to thereby determine a decision reference value;

comparing said decision value with said decision reference value; and correcting either a timing for triggering combustion of said air-fuel mixture or a fuel injection quantity when result of said comparison indicates unsatisfactory combustion state.

19. A control method according to claim 18, wherein a peak value of said ion current is determined as said decision value while said decision reference value is determined as a reference peak value by averaging a plurality of said peak values;

further comprising the steps of:

advancing said ignition timing or alternatively increasing said fuel injection quantity when a difference between said decision value and said decision reference value exceeds a predetermined value.

20. A control method according to claim 19, further comprising the steps of:

multiplying said ion current by an adjustable gain in order to maintain substantially constant a level for detecting said peak value of said ion current regardless of variations in said combustion state;

said gain being employed as said decision value.

* * * * *